US012331949B1

(12) United States Patent
Green et al.

(10) Patent No.: US 12,331,949 B1
(45) Date of Patent: Jun. 17, 2025

(54) SYSTEMS AND METHODS FOR CONTROLLING HEATING, VENTILATION, COOLING, AND POTABLE HOT WATER DELIVERY

(71) Applicant: HARVEST THERMAL, INC., Kensington, CA (US)

(72) Inventors: Evan D. Green, Vista, CA (US); Stephen J. Horne, El Granada, CA (US)

(73) Assignee: HARVEST THERMAL, INC., Kensington, CA (US)

( * ) Notice: Subject to any disclaimer, the term of this patent is extended or adjusted under 35 U.S.C. 154(b) by 0 days.

(21) Appl. No.: 18/978,775

(22) Filed: Dec. 12, 2024

Related U.S. Application Data

(60) Provisional application No. 63/609,548, filed on Dec. 13, 2023.

(51) Int. Cl.

| | |
|---|---|
| ***F24F 11/64*** | (2018.01) |
| ***F24F 5/00*** | (2006.01) |
| ***F24F 11/47*** | (2018.01) |
| ***F24H 7/00*** | (2022.01) |
| ***F24H 15/168*** | (2022.01) |

(52) U.S. Cl.
CPC ..... *F24F 11/64* (2018.01); *F24F 5/0003* (2013.01); *F24F 5/0017* (2013.01); *F24F 11/47* (2018.01); *F24H 7/00* (2013.01); *F24H 15/168* (2022.01)

(58) Field of Classification Search
CPC ..... F24F 11/64; F24F 5/0003; F24F 5/0017; F24F 11/47; F24F 7/00; F24F 15/168
See application file for complete search history.

(56) References Cited

U.S. PATENT DOCUMENTS

| | | | | |
|---|---|---|---|---|
| 2012/0180508 | A1* | 7/2012 | Endoh | F24D 17/02 62/159 |
| 2013/0037249 | A1* | 2/2013 | Manzo | F24F 11/30 165/200 |
| 2014/0230477 | A1* | 8/2014 | Furui | F24D 5/02 62/434 |
| 2015/0204618 | A1* | 7/2015 | Owens | F28D 20/02 165/10 |

* cited by examiner

*Primary Examiner* — Kidest Bahta
(74) *Attorney, Agent, or Firm* — Evergreen Valley Law Group; Kanika Radhakrishnan

(57) ABSTRACT

The present disclosure relates to systems and methods for controlling heating, ventilation, cooling, and potable hot water delivery. The method performed by a control unit includes receiving at least one input signal indicating thermal energy requirements associated with an Air Conditioning and Potable Hot Water (ACPH) system. In response to the at least one input signal, the method includes generating an operating scheme for at least generating thermal outcome corresponding to the thermal energy requirements based on the State of Charge (SoC) of a thermal store, parameters, and operating factors. Further, the method includes selectively operating the thermal store, and the plurality of thermal energy systems based on the operating scheme for supplying the thermal outcome corresponding to the thermal energy requirements. Furthermore, the method includes supplying the thermal outcome corresponding to the thermal energy requirements for at least space conditioning and delivery of potable hot water.

28 Claims, 13 Drawing Sheets

SYSTEMS AND METHODS FOR CONTROLLING HEATING, VENTILATION, COOLING, AND POTABLE HOT WATER DELIVERY

TECHNICAL FIELD

The present disclosure relates to space conditioning and potable hot water delivery systems, and more particularly to systems and methods for controlling heating, ventilating, cooling, and potable hot water delivery by optimizing the operation of a thermal store and heating and cooling systems based at least on thermal energy requirements (such as an end-user demand) to deliver an optimized thermal outcome to the end user.

BACKGROUND

Hydronic systems (an example of fluidic systems) are typically thermo-fluid dynamic systems, configured for home, commercial, or industrial use. The hydronic systems employ water (or water mixtures) as a heat transfer fluid (i.e., medium) for heating or cooling the interiors of the facilities. The hydronic systems typically include a heat source (e.g., boiler) and a cooling source (e.g., chiller) for conditioning spaces or interiors of a building (e.g., homes, industrial facility) as per the requirements of the user.

Conventionally, the hydronic systems use energy sources from the combustion of fuels such as natural gas, propane, coal, fuel oil, and wood for operating boilers to heat the fluid (e.g., water). However, the combustion of these fuels, in addition to being energy intensive, led to the emission of greenhouse gases (GHG) and other pollutants. Currently, the hydronic systems use electricity for generating heat for example by employing high-power resistive heating elements for rapid heating, and/or low-power heat pumps having higher electricity-to-heat conversion efficiency for either heating or cooling purposes. In some hydronic systems, thermal stores are used before heat delivery.

Heating and cooling of a building space can be accomplished by a variety of mechanisms that transfer heat to (in the case of heating systems) or transfer heat from (in the case of cooling systems) the building space. Domestic hot water delivery can be accomplished either by direct delivery of the heat transfer medium (when potable water is used) or indirectly through a heat transfer device (e.g., heat exchanger) to isolate the heat transfer medium from potable water.

When heated or cooled water (or water mixtures) is the medium of conveyance in a space heating and cooling application, it is broadly referred to as hydronic heating or cooling. Example mechanisms of heat transfer to or from the building space are (a) forced air across the coils, in which the building air is forced across the coils while the heated or cooled fluid runs through the coils; (b) passive heat transfer device in which the heated or cooled fluid runs through a building wall, floor or radiator and transfers heat from the building space by a combination of radiative and convective heat transfer. The common factor among these methods is that the heated or cooled medium is circulated (conveyed) to the heating mechanism, cooling mechanism, or combination of mechanisms.

An alternative category of space heating and cooling is the use of refrigerants as the conveying medium, with the distinction compared to the hydronic systems being that refrigerants are intended to operate according to a vapor-compression (refrigeration or heat pump) cycle. The mechanism of heat transfer is designed to operate either the condensing portion of the vapor compression cycle (heating) or the evaporating portion (cooling).

A notable distinction between hydronic heat conveyance and refrigerant heat conveyance is that refrigerants are not typically well-suited to volume storage. Thermal stores are largely designed to use the fluidic medium to convey heating or cooling to or from the heat transfer mechanism.

Heating, Ventilation, and Air Conditioning (HVAC) systems with multiple heating or cooling sources contain logic (or user-operable switching mechanisms) that determines which heating or cooling source to use to respond to an input thermal energy requirements signal based on operating factors. In a typical application, a heat pump may be combined with an Electric Resistance (ER) heater. Such a system would be designed and controlled so that when the outdoor temperature (an operating factor) is above a critical set point, the heat pump is selected to deliver heat in response to the input thermal energy requirements signal; and when the outdoor temperature is below that critical set point, the backup ER heater delivers heat in response to input demand signal. Similarly, two, three or more heat or cooling sources may be configured within a given system.

Potable hot water may be provided by on-demand or storage-based systems. In the case of on-demand, energy consumption is directly related to heat consumption. In the case of storage-based systems, typically a single temperature sensor determines whether to recharge the storage or not. Therefore, energy consumption is strongly correlated to heat consumption because the times of heat consumption determine when the sensor state will change.

The existing heating and cooling systems can select between multiple heating or cooling sources based on point-in-time evaluation of the operating factors, most typically a temperature compared to a threshold above or below which threshold, a given source will be selected to respond to the input thermal energy requirements signal.

SUMMARY

Various embodiments of the present disclosure disclose methods and systems for controlling heating, ventilating, cooling, and potable hot water delivery.

In an embodiment, a computer-implemented method is disclosed. The computer-implemented method performed by a control unit includes receiving at least one input signal indicating thermal energy requirements associated with an Air Conditioning and Potable Hot Water (ACPH) system. In response to the at least one input signal, the method includes generating an operating scheme corresponding to the thermal energy requirements. Further, generating the operating scheme includes monitoring a State of Charge (SoC) of a thermal store associated with the Air Conditioning and Potable Hot Water (ACPH) system. Further, generating the operating scheme includes receiving at least one input related to operating factors. Examples of the operating factors include temperature measurement separate from the thermal energy requirements input signal, currently applicable energy costs, or utility operator preferences (such as a temporary request for energy conservation). Furthermore, generating the operating scheme includes determining a set of parameters including an operating efficiency and an operating capacity associated with a plurality of thermal energy systems associated with the ACPH system. The method includes selectively operating the thermal store, and the plurality of thermal energy systems based on the operating scheme for generating a thermal outcome corresponding to the thermal energy requirements. The method includes supplying the thermal outcome corresponding to the thermal energy requirements for at least space conditioning and potable hot water delivery. The thermal outcome is supplied via a thermal outcome supplying unit associated with the plurality of thermal energy systems.

In another embodiment, an Air Conditioning and Potable Hot Water (ACPH) system is disclosed. The ACPH system includes a thermal store and a plurality of thermal energy systems. The thermal store is configured to store thermal energy. The plurality of thermal energy systems is operatively coupled to the thermal store. Further, the ACPH system includes a control unit operatively coupled to the thermal store and the plurality of thermal energy systems. The control unit is configured to receive at least one input signal indicating thermal energy requirements associated with the Air Conditioning and Potable Hot Water (ACPH) system. In response to the at least one input signal, the control unit generates an operating scheme corresponding to the thermal energy requirements. The control unit is configured to monitor a State of Charge (SoC) of a thermal store associated with the Air Conditioning and Potable Hot Water (ACPH) system. The control unit is further configured to receive at least one input related to operating factors. Exemplary operating factors include temperature measurement separate from the thermal energy requirements input signal, currently applicable energy costs, or utility operator preferences (such as a temporary request for energy conservation). Further, the control unit is configured to determine a set of parameters including an operating efficiency and an operating capacity associated with the plurality of thermal energy systems associated with the ACPH system. Thereafter, the control unit selectively operates the thermal store, and the plurality of thermal energy systems based on the operating scheme for generating a thermal outcome corresponding to the thermal energy requirements. The control unit further facilitates the supply of the thermal outcome corresponding to the thermal energy requirements for at least space conditioning and potable hot water delivery. The thermal outcome is supplied via a thermal outcome supplying unit associated with the plurality of thermal energy systems.

BRIEF DESCRIPTION OF THE DRAWINGS

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1:
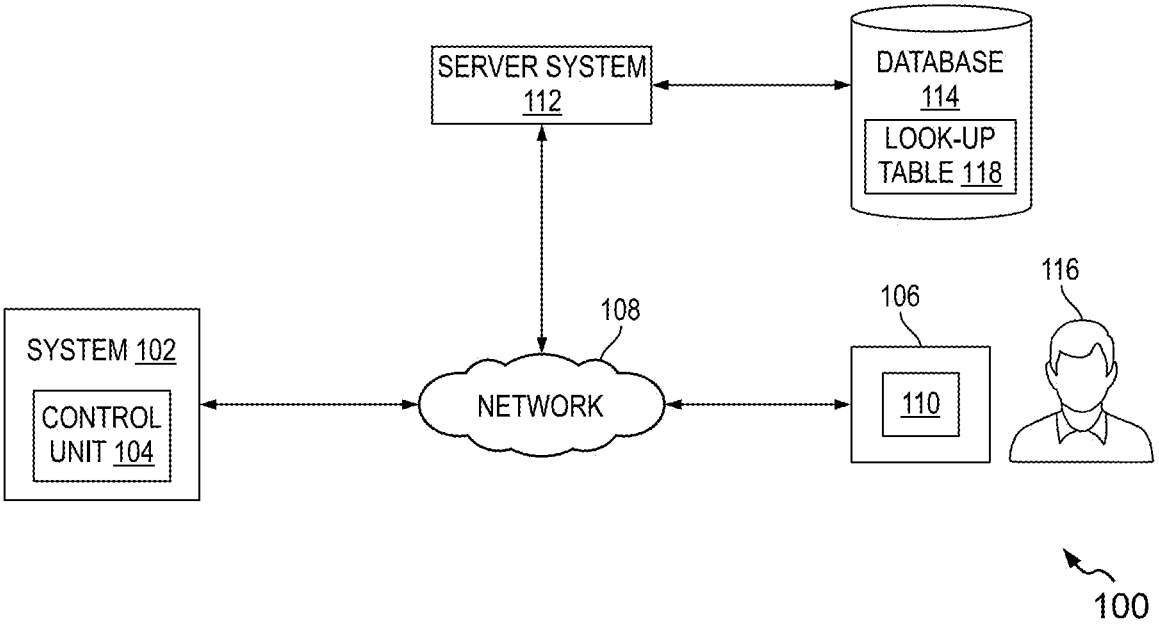
FIG. 1 illustrates an example representation of an environment related to at least some embodiments of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein.

Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification does not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Overview

The term "indoor space", "space" or "end-user space" refers to an enclosed space within a building in need of conditioning (i.e., heating/cooling). The term "indoor space" also refers to the enclosed building space in which the user resides and operates an Air Conditioning and Potable Hot Water (ACPH) system (also referred to as 'the system').

The term "user" or "end-user" refers to an individual or an entity operating the system using a device (e.g., remote) and an application (e.g., software) of the device for conditioning (i.e., heating/cooling) the indoor space.

The term "thermal store" or "thermal storage" refers to an enclosed space (e.g., tank) for storing a medium (e.g., a phase-changing medium) in one or more states, for example, hot, cold, etc.

The term "temperature monitoring device" is a device component to detect thermal energy requirements. In particular, the temperature monitoring device senses whether the temperature is above or below a targeted set point. The temperature monitoring device may have a variety of complexity levels, from single-point single-temperature comparison to multiple zones and time-varying set points.

The term "thermal outcome supplying unit" refers to a unit that receives thermal outcome from a plurality of thermal energy systems and the thermal store and delivers the thermal outcome to the end-user space.

The term "heat pump water heater (HPWH)", or "reversible heat pump water heater (rHWPH)" refers to a heater that heats or cools (i.e., charges) the hydronic medium (e.g., fluid) and pumps the hot or cold fluid to the thermal store or the thermal outcome supplying unit.

The term "Heat Pump (HP)", or "reversible Heat Pump (rHP)" refers to a pump that heats or cools the refrigerant and circulates through the thermal outcome supplying unit.

The term "hydronic loop" refers to the circulation of the medium (e.g., water) from the thermal store to the thermal outcome supplying unit and vice versa, and from the thermal store to the rHPWH or the HPWH, and vice versa.

The term "refrigerant loop" refers to the circulation of the medium (e.g., refrigerant) between the thermal outcome supplying unit and the rHP.

The term "blower" is used to blow air over a refrigerant coil and/or a hydronic coil carrying hot or cold fluid or refrigerant. This results in the air being warmed or cooled before being delivered into the end-user space. In some instances, the blower may also be operated with no source of heating or cooling, for purposes of air circulation.

The term "Heating, Ventilation, and Air Conditioning systems" or "HVAC systems" refers to systems used for delivering heat and/or cold to the end-user using a plurality of conventional heating and cooling systems including air conditioning systems. HVAC is directly related to the sensed temperature conditions of the dwelling. The operation of various systems in HVAC for heating and cooling is controlled based on the information from the temperature monitoring device.

The term "control unit" refers to a component that receives information from the indoor space through the temperature monitoring device or any other information source to determine an optimal source of heating or cooling. The control unit controls the working of rHPWH to deliver heat or cold fluid (e.g., water) to the thermal store through the hydronic loop, or the working of HPWH to deliver heated fluid (e.g., water) to the thermal store through the hydronic loop. The control unit also controls the working of the rHP to deliver heat or cold fluid (e.g., refrigerant) to the thermal outcome supplying unit through the refrigerant loop to deliver cold fluid (e.g., refrigerant) to the thermal outcome supplying unit through the refrigerant loop.

The term "prediction data" refers to the information received by the control unit or an auxiliary controller for determining the optimal source of heating or cooling. An example of external predictive information is weather forecasts and the same can be used for determining the best operating plan for operating the thermal store and/or the conventional heating and cooling systems to satisfy end-user requirements including space heating, space cooling, and potable hot water delivery. By heat transfer means the thermal outcome supplying unit transfers the heat or cold to the end-user space from the medium (water or refrigerant) received from the rHPWH or the rHP.

The term "space heating or space cooling" or "space conditioning" refers to the heating or cooling of an enclosure (or the indoor space) as directed by the control unit of the system.

The term "heat consumption load" is a multi-component unit including but not limited to potable hot water delivery, the thermal outcome supplying unit connected to showers, indoor space for cooling, showers, dishwashers, potable hot water delivery, etc., to meet the thermal energy requirements of the end-user.

The term "rate of heat delivery" refers to the amount of heat that is transferred per unit of time in some material, that is, fluid in the system. The factors that affect the rate of heat delivery in the system include the thermal conductivity of the fluid, the temperature difference of the fluid across spatially separated points, and the flow rate of the fluid in the system. Different materials have greater or lesser resistance to heat transfer, making them better insulators or better conductors.

The term "time of heat production" refers to the moment when incoming power is converted to heat such as by a heat pump, either for storage or instantaneous usage, or a combination of both, or when reversed, refers to the moment when incoming power is used to remove heat from storage or instantaneous extraction from the heat consumption load.

The term "time of heat consumption", "time of delivery" or "time of delivery to end-use" refers to the moment when heating fluid or refrigerant is conveyed to the heat exchange mechanism, such that it is delivered to the end-user space, or hot water fixtures in the case of domestic hot water consumption, or when reversed, refers to the moment when cooled fluid or refrigerant is conveyed to the heat exchange mechanism.

The term "state of charge (SoC)" refers to the quantified thermal energy content of a thermal store. In practice, this may be calculated in varying units of measure, such as kilowatt-hours (kWh), British Thermal Units (BTU), other units of energy, or equivalently volume of fluid available at a fixed or variable temperature.

The term "operating factor" refers to information other than the current state of a demand input signal that can be used to determine an optimal scheme for scheduling and coordination of time of heat production from each of a plurality of heat production systems. Operating factors may include, but not limited to, ambient condition (such as ambient temperature, humidity, etc.), cost of energy sources and prediction data including future thermal energy requirements.

The term "operation cycle" refers to specified periods of time over which an operating factor may be in a particular state. An example is a period of time during which energy costs known or predicted to have an increase or decrease relative to other periods of time.

The term "Y/O signal" refers to the variety of commonly used equipment signals that are typically implemented as 24V ac low power on/off signals transmitted by a set of wires. The wires are commonly labeled as Y (turn on equipment) and O (switch direction of equipment). In some equipment, additional wires are utilized, as may be named for example Y2 (high demand) or AUX (request additional source operation). For descriptive purposes, the "Y/O signal" terminology is used to encompass the multiplicity of such signaling protocols.

Various embodiments of the present invention relate to systems and methods for controlling heating, cooling, and potable hot water delivery by optimizing the operation of the thermal store and the plurality of thermal energy systems based on a State of Charge (SoC) of the thermal store and the thermal energy requirements of the end-user. An embodiment of the system includes:

- one or more control units either integrated into a single physical entity or made up of separate sub-components
- one or more thermal stores, each thermal store tank:
  - Integrated with electric resistance (ER) devices at exit point of the thermal store, or
  - Integrated with the ER devices as part of the thermal stor, or
  - Without the ER devices In one embodiment, the control unit interfaces to standard temperature monitoring devices on commonly available wire protocol (e.g., non-communicating protocol). In one embodiment, the control unit interfaces with the plurality of thermal energy systems using a wire protocol (non-communicating protocol). In one embodiment, the control unit interfaces with the plurality of thermal energy systems using communicating and non-communicating protocols. In one embodiment, the control unit interfaces to some of the plurality of thermal energy systems which may be communicating or non-communicating.

The control unit includes one or more algorithms to direct the delivery of heat or cooling and hot water from the thermal store and/or the plurality of thermal energy systems (hereinafter interchangeably referred to as 'the thermal energy systems') based on the SoC of the thermal store, the thermal energy requirements of the end-user and factors such as low costs, low emissions, high efficiency. The various modes of operation of the present invention are not limited to:

- For heating, deliver heat using at least one of:
  - The thermal store (hot)
  - The thermal energy systems (e.g., reversible heat pump water heater (rHPWH), reversible heat pump (rHP), furnace, etc.)
  - The combination of the thermal store and the thermal energy systems
  - The ER devices
  - The ER devices in the thermal outcome supplying unit
  - Furnace coil in the thermal outcome supplying unit
  - The refrigerant coil in the thermal outcome supplying unit
  - The hydronic coil in the thermal outcome supplying unit
- For Cooling, deliver cooling using at least one of:
  - The thermal store (cold)
  - The air conditioning (AC) unit
  - Cooling systems (e.g., rHPWH, rHP)
  - The refrigerant coil at the thermal outcome supplying unit
  - The hydronic coil at the thermal outcome supplying unit
- For heating and cooling:
  - Combination of the plurality of thermal energy systems and the thermal store based on the SoC of the thermal store and the thermal energy requirements of the end-user
- For domestic water:
  - The thermal store (hot and cold)
  - Other sources of hot or cold water such as utility water, on-demand water heating or cooling, or other It is recognized that rHPWH and rHP may be substituted by HWPW or HP in equivalent embodiments.

In an aspect, the control unit prioritizes the operation of the different components of the ACPH system for costs, emissions, efficiency, or other parameters, taking into account the availability of a volume of fluid in the thermal store which will be able to deliver space conditioning to an enclosure associated with the end-user. An optimal operating scheme is generated by the control unit so that the space conditioning can be delivered to the end-user either from the thermal store and/or the thermal energy systems, based at least on the following, or on other needs:

a. the SoC of the thermal store
b. a charging rate available to the thermal store from the rHPWH
c. expected capacity and efficiency of all sources (e.g., thermal store, and conventional heating and cooling systems) taking into account parameters such as expected ambient temperature.
d. predicted future demand of the end-user (e.g., using forecast weather information)
e. the cost of energy associated with each of the thermal energy systems
f. pollution emissions.

In one aspect, the control unit prioritizes the operation of the different components of the ACPH system for costs, emissions, efficiency, or other parameters, taking into account the availability directly from the thermal store, and/or indirectly through a coupled medium, particularly phase changing material storage, which will be able to deliver thermal outcome corresponding to the thermal energy requirements of the end-user.

In an aspect, the control unit generates control signals to control at least one of the following:

a) Circulation of the hydronic loop from the thermal store to the thermal outcome supplying unit;
b) Turn ON, or turn OFF the rHPWH and operate in a normal mode, or a reversible mode;
c) Control additional LEVEL functionality of the rHPWH as may be particular to a type of the rHPWH such as output temperature or heating/cooling capacity;
d) Turn ON, or turn OFF, the heat pump water heater (HPWH) and operate in the normal mode;
e) Turn ON, or turn OFF, the rHP and operate in the normal mode, or the reversible mode;
f) Control additional LEVEL functionality of the rHP as may be particular to a type of the rHP such as output temperature or heating/cooling capacity; and
g) Turn ON, or turn OFF of AC unit operating in the normal mode.

In an aspect, the control unit generates control signals to control at least one of the following:

a) Control the ER devices at the thermal store;
b) Control the ER devices in the thermal outcome supplying unit; and
c) Control the ER devices in the refrigerant coil.

In an aspect, the control unit system receives an auxiliary signal directly through the temperature monitoring device.

In another aspect, the auxiliary controller associated with the thermal outcome supplying unit receives an auxiliary signal directly through the temperature monitoring device and conveys it to the control unit.

In an aspect, the system includes the thermal store for supplying the thermal outcome (heat or cold) to the thermal outcome supplying unit based on the thermal energy requirements of the end-user. Further, the thermal energy systems are configured to receive operational signals from the control unit and/or auxiliary controller. The operational signals comprise at least one of the standard sets of telemetry and the control signals for the space conditioning. The control unit is configured to at least:

a) adapt to the different characteristics and uses of the standard sets of signals;
b) communicate with the air conditioning (AC) unit on a proprietary communication channel;
c) adapt to different proprietary communication channels;
d) appear to the heating/air conditioning system as the control interface of a standard temperature monitoring device, configured to control rHP; and
e) contain the algorithm designed to minimize the use of traditional heat sources for the Air Conditioning and Potable Hot Water System (ACPH).

In an aspect, the control unit may direct the control unit to operate the rHPWH in the normal or reversible modes to heat or cool the fluid in the thermal store. The fluid from the thermal store passes through the hydronic coil, from where the heat is transferred to or extracted from the atmospheric air, and the heated or cooled atmospheric air is delivered to the end-user space.

In an aspect, the control unit may direct the control unit to operate the rHP in the normal or reversible modes to heat or cool a refrigerant passing through the refringent coil. The refrigerant from the rHP passes through the refrigerant coil, from where the heat is transferred to or extracted from the atmospheric air, and the heated or cooled atmospheric air is delivered to the end-user space.

In an aspect, the refrigerant coil is integrated with the ER devices. The control unit may direct the control unit to operate the rHP in the normal or reversible modes to heat or cool the refrigerant passing through the refringent coil. The refrigerant from the rHP passes through the refrigerant coil, from where the heat or cold is transferred to the atmospheric air, and the heated or cold atmospheric air is delivered to the end-user space. During normal mode (heating mode), the refrigerant is further heated by the ER devices to deliver hot air to the end-user space. In one embodiment, the ER devices are operated (ON/OFF) based on the control signal from the control unit. In another embodiment, the ER devices are operated (ON/OFF) based on the control signal from the auxiliary controller. The auxiliary controller receives the control signal from the control unit.

In an aspect, the ER devices may be installed either in the thermal store or in the hydronic loop from the thermal store to the thermal outcome supplying unit. In one embodiment, the ER devices are operated (ON/OFF) based on the control signal from the auxiliary controller. The auxiliary controller receives the control signal from the control unit.

In an aspect, cooling of the end-user space is achieved by operating one or more of a) the rHPWH in reversible mode to cool water from the thermal store and deliver the cold water to the thermal store, b) the rHP is operated in the reversible mode to receive refrigerant from the refrigerant coil of the thermal outcome supplying unit, the rHP cools the refrigerant and delivers the cold refrigerant to the refrigerant coil; c) by operating the Air Conditioning (AC) unit to cool the end-user space. Cold fluid from the thermal store is delivered to the hydronic coil for cooling the end-user space. The refrigerant coil is used to cool the end-user space using the cold refrigerant from the rHP or the AC unit.

In an aspect, heating of the end-user space and potable hot water delivery is performed using the thermal store and/or the thermal energy systems.

Various example embodiments of the present disclosure are described hereinafter with reference to FIG. 1 to FIG. 10.

FIG. 1 is an example representation of an environment 100 related to at least some embodiments of the present disclosure. Although the environment 100 is presented in one arrangement, other arrangements are also possible where the parts of the environment 100 (or other parts) are arranged or interconnected differently. The environment 100 includes an Air Conditioning and Potable Hot Water (ACPH) system 102 (hereinafter interchangeably referred to as 'the system 102') configured to generate an optimized thermal outcome based at least on thermal energy requirements associated with an end-user.

Further, the environment 100 includes a network 108, a server system 112, a database 114, and a user 116. The user 116 (also referred to as the end-user 116) may be an individual or an entity, who requires space conditioning (i.e., heating/cooling) and potable hot water delivery in an indoor space. The user 116 is associated with a device 106 installed with an application 110, for providing user input. The user input may include thermal energy requirements. The user 116 uses an application 110 (i.e., an interactive application) on the device 106 to provide the user input to the system 102. The device 106 may be any electronic device, such as, but not limited to, a Personal Computer (PC), a tablet device, a Personal Digital Assistant (PDA), a voice-activated assistant, wearable devices, a Virtual Reality (VR) device, a smartphone, and a laptop. In one embodiment, the thermal energy requirements may include prediction data (e.g., weather forecast information). In some embodiments, the system 102 receives the prediction data at predetermined intervals from the device 106 and/or the server system 112. Based on the thermal energy requirements, a control unit 104 in the system 102 performs selective control of various heating and cooling systems to obtain an operating scheme for space conditioning and potable hot water delivery.

The network 108 may include, without limitation, a light fidelity (Li-Fi) network, a Local Area Network (LAN), a Wide Area Network (WAN), a Metropolitan Area Network (MAN), a satellite network, the Internet, a fiber-optic network, a coaxial cable network, an infrared (IR) network, a Radio Frequency (RF) network, a virtual network, and/or another suitable public and/or private network capable of supporting communication among the entities illustrated in FIG. 1, or any combination thereof.

The server system 112 is configured to host and manage the application 110, which is accessible to the device 106 via the network 108. The application 110 may be accessible through a website associated with the server system 112, so that the user 116 may access the website over the network 108 using web browser applications installed in the device 106 and, thereafter perceive to operate the system 102. In an embodiment, the server system 112 is configured to facilitate instances of the application 110 to the device 106, upon receiving a request for accessing the application 110. The server system 112 upon receiving the request via the network 108 allows instances of the application 110 to be downloaded into the device 106 for accessing the application 110. In an embodiment, the application 110 is also configured to generate and dynamically update a dashboard (not shown in FIG. 1) by including the user input provided by the user 116. In another embodiment, the application 110 is also configured to generate and dynamically update the dashboard by including estimated costs associated with the operation of the system 102 based on the user input. The database 114 connected to the server system 112 is configured to store information about the user input provided by the user 116. The database 114 may include a look-up table 118. The look-up table may be configured to store costs, emissions, a schedule of operation of a power source, operation cycles, and the like. The database 114 may be maintained by a third party or embodied within the server system 112. The database 114 may include multiple storage units such as hard disks and/or solid-state disks in reliable data storage. The database 114 may also include a Storage Area Network (SAN) and/or a Network Attached Storage (NAS) system.

In one embodiment, the control unit 104 controls the operation of the system 102 based on the thermal energy requirements. It shall be noted that the control unit 104 may be a standalone component operating apart from the system 102 for controlling operations of the system 102. However, in other embodiments, the control unit 104 may be incorporated, in whole or in part, into one or more parts of the environment 100, for example, the server system 112. Further, the control unit 104 should be understood to be embodied in at least one computing device which may be specifically configured, via executable instructions, to perform as described herein, and/or embodied in at least one non-transitory computer-readable media.

The system 102 is configured to perform one or more of the operations described herein. In particular, the control unit 104 is configured to adapt one or more parameters of the system 102 for managing the thermal outcome of the system 102. In one example, the user 116 may preset a rate of heat delivery (e.g., 10,000 BTU/hour) for the system 102 for cost savings. During use, the user 116 may provide the user input to increase the temperature of the indoor space on a cold day. In such scenarios, increasing ambient room temperature may require a higher rate of heat delivery. As such, the control unit 104 adapts a parameter (e.g., flow rate, temperature) associated with the rate of heat delivery to increase the rate of heat delivery until the temperature requirements provided by the user 116 are met.

In an embodiment, the control unit 104 may be configured to receive at least one input signal. The at least one input signal indicates the thermal energy requirements associated with the system 102. For example, the thermal energy requirements may include heating, cooling, and potable hot water delivery. Thereafter, the control unit 104 generates an operating scheme corresponding to the thermal energy requirements. To generate the operating scheme, the control unit 104 is configured to monitor a State of Charge (SoC) of a thermal store (not shown in FIG. 1) associated with the system 102. Further, the control unit 104 may determine a set of parameters of a plurality of thermal energy systems (not shown in FIG. 1) associated with the system 102. The set of parameters may include an operating efficiency, an operating capacity, and a charging rate of the plurality of thermal energy systems. Furthermore, the control unit 104 may be configured to receive at least one input related to operating factors. The operating factors may include, but not limited to, ambient condition (such as ambient temperature, humidity, etc.) and prediction data including future thermal energy requirements. The prediction data is determined based on historical usage patterns and the ambient condition. The control unit 104 further selectively operates the thermal store and the plurality of thermal energy systems based on the operating scheme for generating the thermal outcome corresponding to the thermal energy requirements. Thereafter, the control unit 104 supplies the thermal outcome corresponding to the thermal energy requirements for at least the space conditioning and the potable hot water delivery. The thermal outcome is supplied via a thermal outcome supplying unit (not shown in FIG. 1) associated with the plurality of thermal energy systems.

The number and arrangement of systems, devices, and/or networks shown in FIG. 1 are provided as an example. There may be additional systems, devices, and/or networks; fewer systems, devices, and/or networks; different systems, devices, and/or networks; and/or differently arranged systems, devices, and/or networks than those shown in FIG. 1. Furthermore, two or more systems or devices shown in FIG. 1 may be implemented within a single system or device, or a single system or device shown in FIG. 1 may be implemented as multiple, distributed systems or devices. Additionally, or alternatively, a set of systems (e.g., one or more systems) or a set of devices (e.g., one or more devices) of the environment 100 may perform one or more functions described as being performed by another set of systems or another set of devices of the environment 100.

Figure 2:
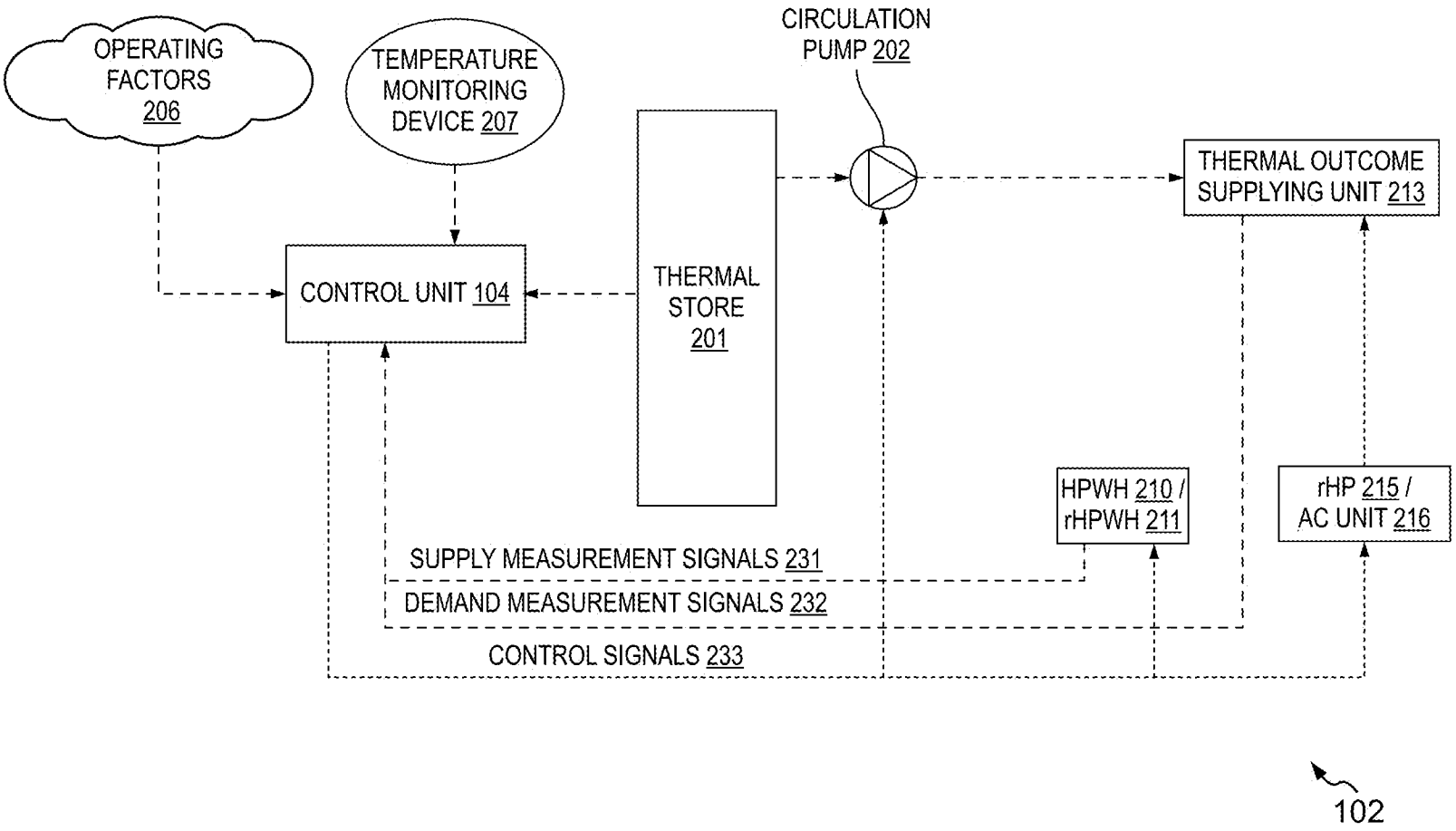
FIG. 2 illustrates a schematic block diagram representation of an Air Conditioning and Potable Hot Water (ACPH) system, in accordance with an embodiment of the present disclosure.

FIG. 2 illustrates a schematic diagram of the system 102 for generating the thermal outcome corresponding to the thermal energy requirements, in accordance with an embodiment of the present disclosure. The system 102 includes a thermal store 201. The thermal store 201 is configured to store fluid therein. The thermal store 201 may be configured with a thermal shielding surface (not shown in FIG. 2) for maintaining the temperature of the fluid therein. For example, the thermal store 201 may be a stratified storage tank. In other words, there may be compartments (not shown in FIG. 2) in the thermal store 201 formed due to the temperature difference between hot fluid, warm fluid, and cold fluid in the stored fluid inside the thermal store 201. In general, a thermocline layer (not shown in FIG. 2) within the thermal store 201 forms the compartments due to significant differences in temperatures. In one implementation, the hot fluid may be fluid heated to a temperature between 130° F.-170° F., the lukewarm fluid may be fluid at room temperature (e.g., 68° F.-72° F.), and the cold fluid (or refrigerant fluid) may be the fluid cooled to temperatures of 50° F. or any other temperature as per requirement.

Further, the thermal store 201 is fluidically coupled to a pump 202 (also referred to as 'circulation pump 202'). Furthermore, the thermal store 201 may be fluidically coupled to the pump 202 via the control unit 104 to enable the circulation of the hot fluid and the cold fluid suitably. The pump 202 is further fluidically coupled to a thermal outcome supplying unit 213. As such, the pump 202 is configured to circulate or route at least the hot fluid, the cold fluid, and the lukewarm fluid suitably within the system 102 through a hydronic loop (not shown in FIG. 2) from the thermal store 201. In some embodiments, the pump 202 may be embodied in the control unit 104.

The control unit 104 is fluidically coupled to a plurality of thermal energy systems. The plurality of thermal energy systems (hereinafter interchangeably referred to as 'the thermal energy systems') may include a heat pump water heater (HPWH) 210, a reversible heat pump water heater (rHPWH) 211, a reversible heat pump (rHP) 215, an air conditioning (AC) unit 216, and the like. The HPWH 210 or the HPWH 211 is configured to direct thermal fluid to the thermal store 201 or the thermal outcome supplying unit 213, or a combination thereof. In some embodiments, the pump 202 may be integrated into the control unit 104.

The system 102 further includes a temperature monitoring device 207 communicably coupled to the control unit 104. The temperature monitoring device 207 may transmit the at least one input signal to the control unit. In particular, the temperature monitoring device 207 may detect any change in temperature from the required thermal value (e.g., as preset by the user 116) or temperature value in the system 102 suitably and provides such data (i.e., the at least one input signal) to the control unit 104. The at least one input signal may indicate the thermal energy requirements. The control unit 104 further receives supply measurement signals 231 from the rHPWP 211/HPWH 210. The control unit 104 further receives demand measurement signals 232 from the thermal outcome supplying unit 213. Herein, the demand measurement signals 232 and the supply measurement signals 231 may correspond to the at least one input signal being transmitted to the control unit 104. The demand measurement signals 232 and the supply measurement signals 231 may provide information related to the thermal energy requirements. Further, the control unit 104 may receive operating factors 206. The operating factors 206 may include, but not limited to, ambient condition (such as ambient temperature, humidity, etc.) and prediction data including future thermal energy requirements. The prediction data is determined based on historical usage patterns and the ambient condition.

The control unit 104 may include a set of instructions of an algorithm that processes the operating factors 206, the supply measurement signals 231, and the demand measurement signals 232 and generates an operating scheme for selectively operating the thermal energy systems and the thermal store 201. The control unit 104 further sends control signals 233 to the circulation pump 202, the thermal energy systems such as the heat pump (e.g., the HPWH 210/the rHPWH 211, and the rHP 215/the air conditioning (AC) unit 216) to operate based on the operating scheme.

The control unit 104 operates the circulation pump 202 based on the operating scheme, such that the heat or cold fluid from the thermal store 201 can be used by the thermal outcome supplying unit 213. The thermal outcome supplying unit 213 supplies heat or cool air to the end-user space/enclosure. Further, the system 102 also includes the heat pump (e.g., the HPWH 210, or the rHPWH 211) for the flow of hydronic liquid (not shown in FIG. 2) to the thermal store 201 via a hydronic loop (not shown in FIG. 2). The rHP 215 is used for the flow of refrigerant fluid via a refrigerant loop (not shown in FIG. 2) into the thermal outcome supplying unit 213. As explained above, the control unit 104 sends the control signals 233 to selectively operate the thermal store 201, and the thermal energy systems such as the rHPWH 211, the HPWH 210, and the rHP 215 based on the operating scheme.

In an embodiment, the system 102 may be configured with a set of flowmeters (not shown in FIG. 2) mounted at an inlet and outlet (not shown in FIG. 2) of the thermal store 201. The set of flowmeters is configured to monitor the volume of the fluid entering and leaving the thermal store 201 over time and thereby enable the control unit 104 to determine the volume of the hot fluid in the thermal store 201. The set of flowmeters may be one of an optical sensor, a mechanical sensor, or any other sensor configured for monitoring the fluid flow within the conduits entering and leaving the thermal store 201. The system 102 may also include a set of temperature sensors (not shown in FIG. 2) mounted to the conduit exiting and entering the portion (not shown in FIG. 2) of the thermal store 201 containing the fluid. The set of temperature sensors is configured to monitor the temperature of the fluid exiting or entering the thermal store 201.

In one embodiment, the temperature sensors installed within the thermal store 201 are configured to monitor the temperature of the hot fluid within thermal store 201. In one configuration, the hydronic loop extending from the thermal store 201 is used for supplying the hot fluid to the thermal outcome supplying unit 213. In another configuration, the hydronic loop is used to supply cold fluid from the thermal store 201 to the heat pump (e.g., the HPWH 210, or the rHPWH 211). In another configuration, the hydronic loop extending from the rHP 215/the AC unit 216 is used for supplying the refrigerated fluid to the thermal outcome supplying unit 213. The thermal outcome supplying unit 213, on receiving either the hot fluid or the refrigerated fluid, distributes the heat content to the end-user space for the space conditioning. Examples of the thermal outcome supplying unit 213 may include but are not limited to, a blower, a radiator, and a hydronic panel configured for distributing the heat content into the end-user space. The thermal outcome supplying unit 213 may include a plurality of heat transfer components connected, for example, a plurality of radiators connected in series to provide adequate heating/cooling to the enclosure.

In an embodiment, the control unit 104 may be configured to receive at least one input signal. The at least one input signal indicates the thermal energy requirements associated with the system 102. For example, the thermal energy requirements may include heating, cooling, and potable hot water delivery requirements. Thereafter, the control unit 104 generates the operating scheme corresponding to the thermal energy requirements. To generate the operating scheme, the control unit 104 is configured to determine the State of Charge (SoC) of the thermal store 201. Further, the control unit 104 may determine the set of parameters of the thermal energy systems associated with the system 102. The set of parameters may include the operating efficiency, the operating capacity, and the charging rate of the thermal energy systems. Furthermore, the control unit 104 may be configured to receive the inputs related to the operating factors 206. The control unit 104 further selectively operates the thermal store 201 and the thermal energy systems based on the operating scheme for generating the thermal outcome corresponding to the thermal energy requirements. Herein the thermal outcome refers to the heating, cooling, and potable hot water delivery to the user 116. Thereafter, the control unit 104 supplies the thermal outcome corresponding to the thermal energy requirements for at least the space conditioning (i.e., heating and cooling) and the potable hot water delivery. The thermal outcome is supplied via the thermal outcome supplying unit 213 associated with the plurality of thermal energy systems.

In an embodiment, the at least one control signal for selectively operating the thermal store 201, the plurality of thermal energy systems, and the thermal outcome supplying unit is communicated using at least one second signal protocol. Further, the at least one input signal indicating the thermal energy requirements is communicated using at least one first signal protocol.

In an embodiment, the at least one control signal for selectively operating the thermal store 201 and the plurality of thermal energy systems based on the operating scheme may include one of an ON instruction, an OFF instruction, and a LEVEL determination instruction to select at least one of the operating capacity of the thermal store 201 and one or more of the plurality of thermal energy systems which will be explained further in detail.

In one example, the at least one input signal is received from the temperature monitoring device 207. In this example, the at least one input signal indicates the thermal energy requirements related to the space conditioning. The space conditioning includes one of heating and cooling of the enclosure (also referred to as 'the end-user space' or 'the indoor space') associated with the user 116. In this example scenario, the control unit 104 is configured to generate the operating scheme corresponding to the space conditioning based at least on the thermal energy requirements related to the space conditioning, the SoC of the thermal store 201, an operation cycle, and the set of parameters associated with the thermal energy systems. Thereafter, the control unit 104 selectively operates the thermal energy systems (such as the rHP 215, the AC unit 216, the HPWH 210, the rHPWH 211, or the combination thereof) and the thermal store 201 based at least on the operating scheme to supply the thermal outcome for one of the heating and cooling of the enclosure associated with the user 116. In particular, the control unit 104 generates the operating scheme corresponding to the thermal energy requirements related to the space conditioning based at least on the operation cycle. The operation cycle includes the factors of a cost, emissions, and a schedule of operation of a power source. The operation cycle may be at least an off-peak operation cycle and an on-peak operation cycle. In this example, the operation cycle is the off-peak operation cycle.

In one implementation, the on-peak operation cycle may be the time period in which the demand for use of the system 102 will be the highest. As an example, the time period between 6 AM to 9 AM and 6 PM to 9 PM of a day, where the user 116 is engaged in daily activities, may be considered as the on-peak operation cycle. In another implementation, the on-peak operation cycle may be the time at which the cost of energy is highest. As an example, the time period between 5 pm and 9 pm, may be the time at which the cost of energy is highest. The off-peak operation cycle may be the remainder time period of the day. Further, in the off-peak operation cycle, the energy often comes from cleaner, more efficient sources such as renewables. Thus, by using this energy to recharge the thermal store 201, the system 102 contributes to lower greenhouse gas emissions. In one implementation, the on-peak operation cycle may also be based on the load acting or the demand for the hot water and/or cold water for the enclosure of the user 116. Further, the cost and the schedule of operation of the power source are defined in the look-up table 118 configured in the database 114 communicably coupled to the control unit 104. For instance, the cost of the power source may represent the price of the power source, the emissions due to that power source, or any other parameter.

Thereafter, the control unit 104 selectively operates the thermal energy systems based at least on the operating scheme to supply the thermal outcome for the space conditioning. Further, the thermal outcome being generated in the off-peak operation cycle by selectively operating the thermal energy systems is used to recharge the volume of the fluid stored in the thermal store 201 for utilization in future thermal demand. This configuration ensures that the thermal energy systems are operated selectively, thereby reducing the cost of operation, and the emissions generated during the use of the power or other relevant parameters, while also optimizing the performance of operation of the system 102. In other words, the system 102 can switch between utilizing the stored energy of the thermal store 201 and active generation by operating the thermal energy systems based on the real-time SoC, the thermal energy requirements, and energy cost data.

In another example, the control unit 104 may receive the at least one input signal indicating the thermal energy requirements for the space conditioning. In this example scenario, the control unit 104 may determine the SoC of the thermal store 201 is at least equivalent to (i.e., the SoC of the thermal store 201 is equal to or greater than) the thermal energy requirements for the space conditioning. The operation cycle may be the on-peak operation cycle or the off-peak operation cycle. In this scenario, the control unit 104 instantaneously operates the thermal outcome supplying unit 213 operatively coupled to the thermal store 201 to supply the thermal outcome by utilizing the thermal store 201 for the space conditioning. Thus, it is understood that when the SoC exceeds the thermal energy requirements ensures that the previously stored during the on-peak and the off-peak operation cycles are used effectively. Further, relying on the thermal store 201 eliminates the need to operate the thermal energy systems at higher rates, thus lowering operational costs. Furthermore, using the previously stored thermal energy instead of operating the thermal energy systems during the on-peak operation cycle reduces carbon emissions.

In another example, the control unit 104 may determine the SoC of the thermal store 201 is less than the thermal energy requirements for the space conditioning. In this example scenario, the control unit 104 generates the operating scheme in response to the SoC of the thermal store 201 being less than the thermal energy requirements for the space conditioning, the set of parameters of the thermal energy systems, and the operation cycle. The operation cycle may be one of the on-peak operation cycle and the off-peak operation cycle. In this scenario, the control unit 104 controls the thermal outcome supplying unit 213 to selectively operate the thermal energy systems and the thermal store 201 to supply the thermal outcome corresponding to the thermal energy requirements related to the space conditioning. In this scenario, selectively operating the thermal store 201 and the thermal energy systems ensures continuous heating or cooling (i.e., the space conditioning) as per the thermal energy requirements, even when the SoC of the thermal store 201 is low. Thus, the system 102 dynamically balances energy sources, drawing from the thermal store 201 and the thermal energy systems to meet the thermal energy requirements efficiently.

In another example, the at least one input signal indicates the thermal energy requirements related to the potable hot water delivery. In an embodiment, the at least one input signal may be received from the network 108 based on the user inputs in the application 110. In another embodiment, the at least one input signal may be received at the control unit 104 based on monitoring the components (such as shower, faucet, and the like) associated with delivering hot water to the user 116. In this scenario, the control unit 104 may determine the SoC of the thermal store 201 is at least equivalent to (i.e., the SoC of the thermal store 201 is equal to or greater than) the thermal energy requirements of the potable hot water delivery. For example, the thermal energy requirements (or the temperature) of the potable hot water delivery may be 60 degrees Celsius and the SoC of the thermal store 201 is equivalent to the required temperature for the potable hot water delivery. In this scenario, the control unit 104 generates the operating scheme corresponding to the thermal energy requirements of the potable hot water delivery in response to determining the SoC of the thermal store is equal to or greater than the thermal energy requirements of the potable hot water delivery, and the operation cycle. The operation cycle may be one of the on-peak operation cycle and the off-peak operation cycle. Thereafter, the control unit 104 instantaneously operates the thermal outcome supplying unit 213 operatively coupled to the thermal store 201 to provide the thermal outcome for the potable hot water delivery based on the operating scheme. It is to be noted that creating the operating scheme for the potable hot water delivery by leveraging the thermal store 201 when its SoC is sufficient to meet the thermal energy requirements offers several operational, cost, and environmental benefits.

In another example, the control unit 104 may determine the SoC of the thermal store 201 is less than the thermal energy requirements of the potable hot water delivery. In this example scenario, the control unit 104 generates the operating scheme corresponding to the thermal energy requirements related to the potable hot water delivery in response to determining the SoC of the thermal store is less than the thermal energy requirements of the potable hot water delivery. Further, in this scenario, the operation cycle may be the on-peak operation cycle. Also, the control unit 104 may determine the set of parameters of each of the plurality of thermal energy systems for generating the operating scheme. Thereafter, the control unit 104 controls the thermal outcome supplying unit 213 for selectively operating the thermal store and the plurality of thermal energy systems to provide the thermal outcome based on the operating scheme for the potable hot water delivery. For example, the SoC of the thermal store 201 or the temperature of the fluid in the thermal store 201 may be 1 kWh, and the thermal energy requirements of the potable hot water may be 3 kWh. Thus, the control unit 104 is configured to utilize the fluid stored in the thermal store 201 and operate the thermal energy systems (e.g., the rHP 215) to recharge the volume of the fluid in the thermal store 201 based on the predicted thermal energy requirements (e.g., 2 kWh). Thus, it is to be understood that the control unit 104 is configured to dynamically combine the thermal energy from the thermal store 201 with active heating systems (such as the thermal energy systems) based on real-time demand and availability, thus optimizing the performance of the system 102.

In another example, the control unit 104 may receive the at least one input signal indicating the thermal energy requirements related to the potable hot water delivery during the off-peak operation cycle. In this scenario, the control unit 104 may generate the operating scheme corresponding to the thermal energy requirements related to the potable hot water delivery based at least on the operation cycle. The operation cycle may include the cost, emissions, and the schedule of operation of the power source. Further, the cost and the schedule of operation of the power source may be defined in the look-up table 118. Thereafter, the control unit 104 selectively operates the thermal energy systems based at least on the operating scheme to supply the thermal outcome for the potable hot water delivery. Thus, the operating scheme is generated by anticipating the thermal energy requirements of the system 102 based on the current SoC and available off-peak energy. This results in better load management and smoother transitions between thermal store 201 and active energy use by the thermal energy systems. The various embodiments and configurations of the system 102 to supply the thermal outcome corresponding to the operating scheme, the real-time demand, the SoC of the thermal store 201, and the like are explained further in the description.

In an embodiment, the system 102 may include a selector switch (not shown in figures) operatively coupled to the control unit 104. The selector switch is configured to adjust a flow path of the thermal outcome based at least on the SoC of the thermal store 201, the thermal energy requirements, the operation cycle, and the set of parameters of the thermal energy systems. In other words, hydraulic pressure balance, or the separation of heating and cooling functions may necessitate the use of the selector switch to dictate whether the fluid bypasses the thermal store 201.

In one configuration, the heat pump (e.g., the rHPWH 211) is configured for generating either the hot fluid or the cold fluid. In such a scenario, the heat pump acts as the rHPWH 211 and works in either a heating mode (a normal mode) or a cooling mode (a reverse mode). While working in the heating mode, the heat pump (e.g., the rHPWH 211) supplies the hot fluid to the thermal store 201. While working in the cooling mode, the heat pump (e.g., the rHPWH 211) supplies the cold fluid to the thermal store 201. From the thermal store 201, the hot fluid or cold fluid can be supplied to the hydronic coil to satisfy the heating and cooling requirements of the end-user such as the user 116. After exchanging the heat or cold to the end-user space, the fluid is sent back to the thermal store 201, via the hydronic loop.

In one configuration, the heat pump (e.g., the HPWH 210). is configured for generating only the hot fluid and works in the heating mode. In this configuration, the heat pump (e.g., the HPWH 210) supplies the hot fluid to the thermal store 201. From the thermal store 201, the hot fluid can be supplied to the hydronic coil to satisfy the heating requirements of the end-user. After exchanging the heat to the end-user space, the fluid is sent back to the thermal store 201, via the hydronic loop.

In one embodiment, the refrigerant flowing through the AC unit 216 and a refrigerant coil (not shown in FIG. 2) is cooled by the AC unit 216 to meet the space cooling of the end-user. In another embodiment, the rHP 215 works in either the heating mode or the cooling mode. While working in the heating mode, the rHP 215 supplies hot refrigerant to the refrigerant coil. While working in the cooling mode, the rHP 215 supplies cold refrigerant to the refrigerant coil. After exchanging the heat or cold to the end-user space, the refrigerant is circulated back to the rHP 215, via the refrigerant loop.

In one implementation, the control unit 104 may automatically determine the thermal energy requirements of the end-user space (such as the user 116) from the prediction data. Accordingly, the control unit 104 operates the system 102 for the space conditioning. To that effect, the control unit 104 determines the operating scheme for generating the thermal outcome based on the thermal energy requirements. Further, the control unit 104 is configured to selectively operate the thermal energy systems and the thermal store 201 to ensure optimal operational efficiency, while incurring minimal operation costs, emissions, or any other parameter.

Figure 3A:
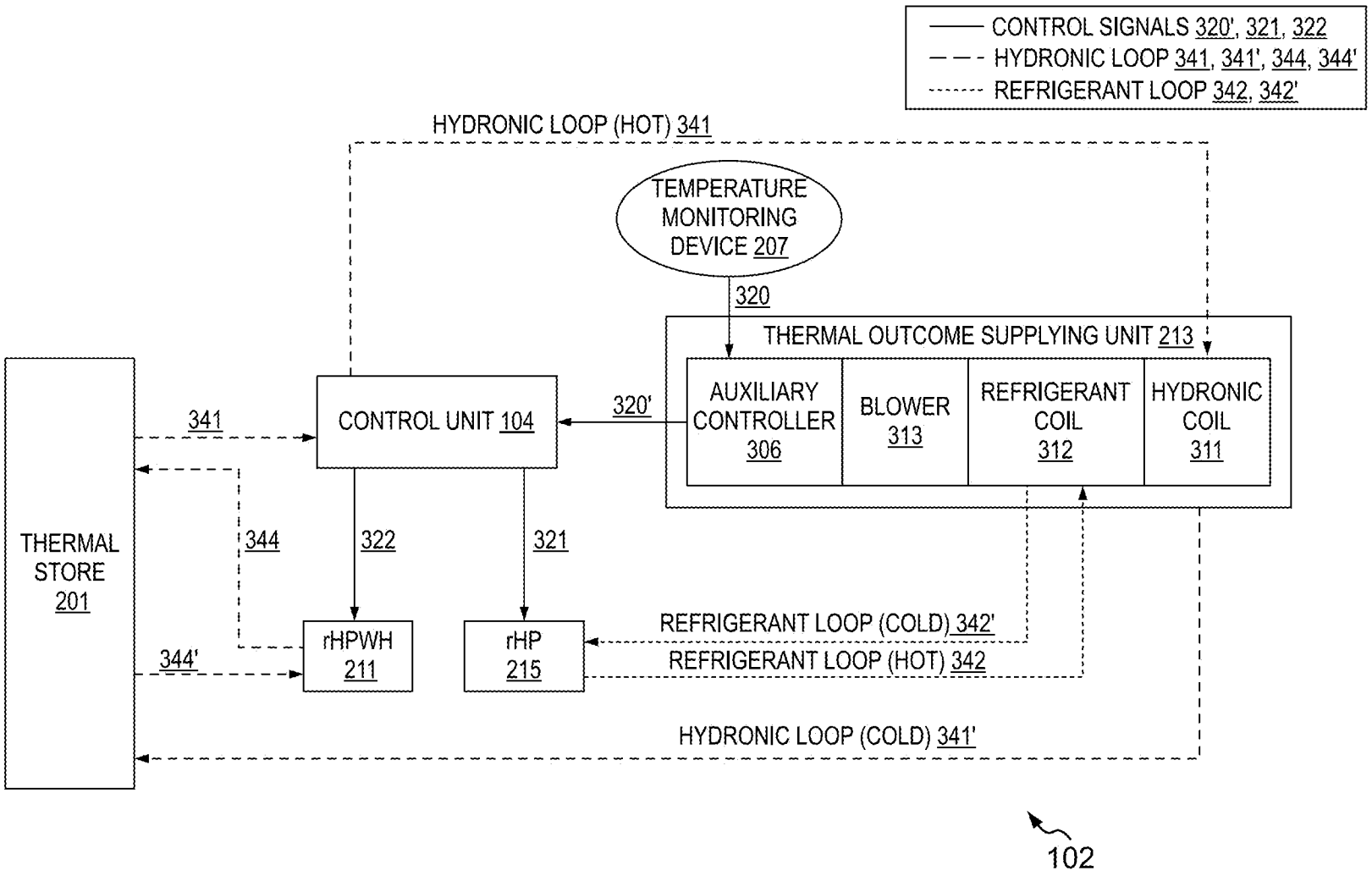
FIG. 3A illustrates a schematic diagram of an operating configuration of the ACPH system of FIG. 2 showing a thermal outcome supplying unit connected to a temperature monitoring device, in accordance with an embodiment of the present disclosure.

FIG. 3A illustrates a schematic diagram of an operating configuration of the system 102, in accordance with an embodiment of the present disclosure. As shown, the thermal outcome supplying unit 213 includes an auxiliary controller 306. The auxiliary controller 306 is configured to receive the information 320 from the temperature monitoring device 207 using at least one of W/Y/G and Y/O/G wiring standards (i.e., at least one signal). The control unit 104 receives the at least one signal (e.g., the supply measurement signals 231, demand measurement signals 232, and the operating factors 206). The auxiliary controller 306 operates according to its normal control algorithms signal 320' that would signal the rHP 215 to operate. In this embodiment, the signal 320' is wired to the control unit 104 via Y/O wiring standards. The control unit 104 is interfaced with the rHP 215 via Y/O wiring standards and sends the control signal 321 to the rHP 215 based on the algorithm of the control unit 104. Based on the operating scheme, the control unit 104 sends ON/OFF/LEVELsignal 322 to the rHPWH 211. The significance of LEVEL signaling is that an operating scheme may account for the variable operating efficiency of rHPWH or rHP at differing capacity levels, and therefore signal to the equipment to operate at differing capacity according to the optimized operating scheme.

The rHPWH 211 receives fluid (e.g., cold fluid 344') from the thermal store 201, heats the fluid, and sends it back to the thermal store 201. The heat or cold in the thermal store 201 is stored if the cost, the operation cycle, and the set of parameters of the thermal storage systems are favorable. The stored heat or cold from the thermal store 201 can be used when the usage of the rHPWH is not favorable.

The various modes at which the system 102 of FIG. 3A can be operated based on the operating scheme for heating not limited to:

i. The thermal store 201: In this mode, the thermal energy stored in the thermal store 201 is supplied to the hydronic coil 311 through the hydronic loop (e.g., hydronic loop (hot) 341) for fulfilling the heating requirement of the end-user.

ii. rHPWH and thermal store: The rHPWH 211 is operated in the normal mode (i.e., heating mode) to heat the fluid passing through it. In this mode, the fluid in the thermal store 201 is heated (via hydronic loop (cold) 341') and supplied (via the hydronic loop (hot) 341) to the thermal store 201. From the thermal store 201, the hot fluid is supplied to the hydronic coil 311 through the hydronic loop (e.g., the hydronic loop (hot) 341) to fulfill the heating requirement of the end-user. After heat exchange from the hydronic coil 311 in the thermal outcome supplying unit 213, the fluid (e.g., the hydronic loop (cold) 341') is sent back to the thermal store 201.

iii. rHP only: The rHP 215 is operated in the normal mode (i.e., heating mode) to heat the refrigerant passing through it. In this mode, the refrigerant (via refrigerant loop (cold) 342') flowing through the rHP 215 is heated and supplied (via refrigerant loop (hot) 342) to a refrigerant coil 312 to fulfill the heating requirement of the end-user. After heat exchange from the refrigerant coil 312 in the thermal outcome supplying unit 213, the refrigerant (e.g., the refrigerant loop 342') is circulated back to the rHP 215. When reversed for cooling, the refrigerant flow is opposite from the refrigerant loop (cold) 342' to the refrigerant coil 312 and back to the rHP 215 using the refrigerant loop (hot) 342.

iv. In modes i-iii, the blower 313 is operated to transfer heat from the hydronic coil 311 and the refrigerant coil 312 within the thermal outcome supplying unit 213 to the end-user space.

V. Blower only: In this mode, the temperature monitoring device 207 can operate the blower 313 to circulate air in the end-user space.

vi. Combination of at least one of i. to v mentioned above.

TABLE 1: Various possible modes, interfaces, and operations of the system 102 of FIG. 3A are shown below:

| Design Logic | | | | | |
|---|---|---|---|---|---|
| The Temperature monitoring device 207 | State | The Control signal 320' | The Control signal 321 | The Control unit 104 | Explanation |
| Call for Heat | Hydronic preferred | Y | — | Circulation ON | Use thermal store when favorable |
| Call for Heat | rHP preferred | Y | Y | — | Use rHP when necessary |
| Call for Heat | rHP preferred | Y | Y | Circulation ON | Use thermal store and rHP when favorable |
| Call for Cool | Any | O + Y | O + Y | — | Normal air conditioning |
| Fan | Any | — | — | — | Normal fan operation |
| Aux | Any | Varies | Varies | — | Auxiliary functions unchanged |

-continued

| Design Logic | | | | | |
|---|---|---|---|---|---|
| The Temperature monitoring device 207 | State | The Control signal 320' | The Control signal 321 | The Control unit 104 | Explanation |
| NA | Any | Any | Any | rHPWH ON | Charge thermal store when needed |
| NA | Any | Any | Any | rHPWH LEVEL | Charge thermal store at a selected charging rate (LEVEL) |

Figure 8:
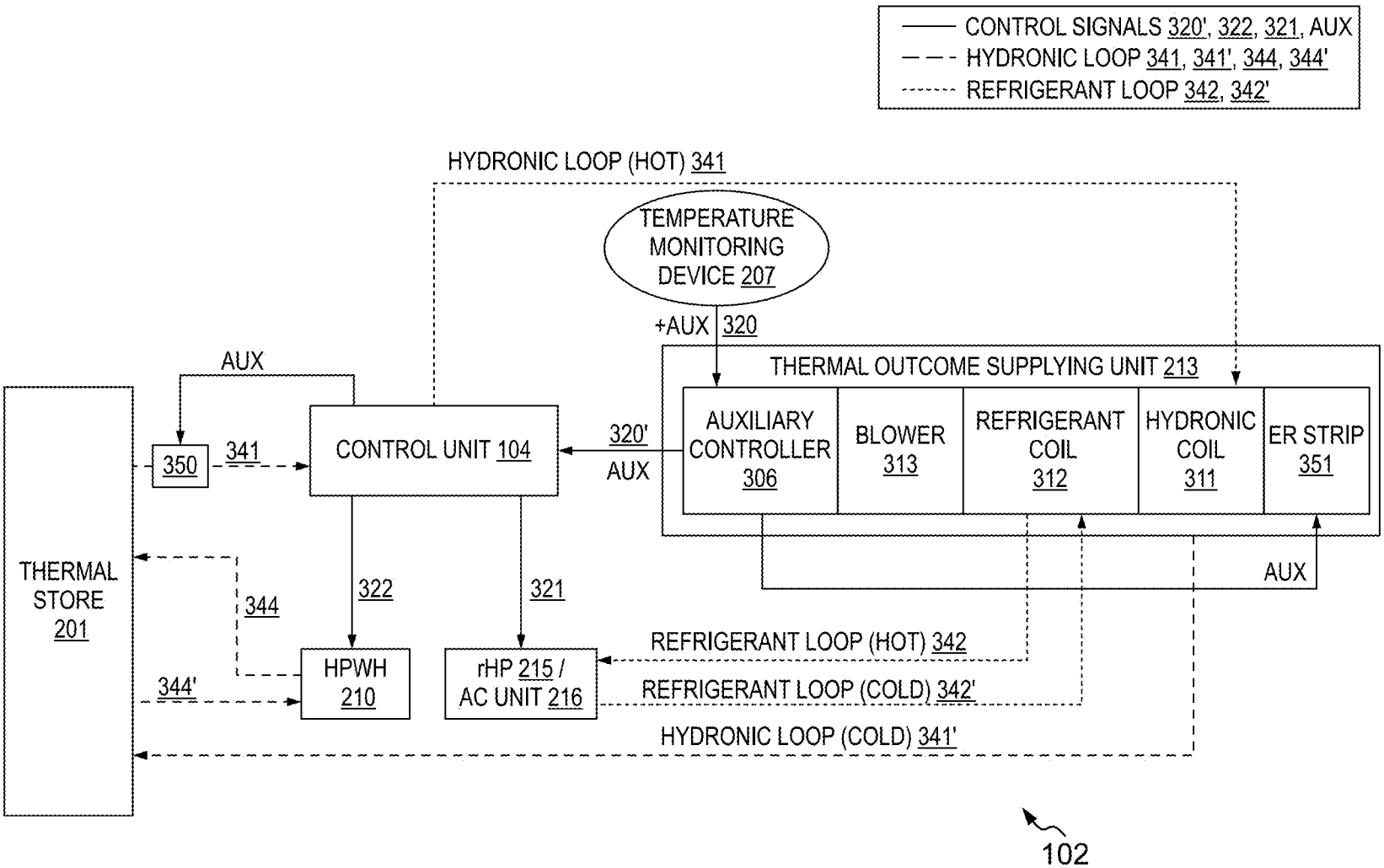
FIG. 8 illustrates a schematic diagram of an operating configuration of the ACPH system of FIG. 3B, depicting the auxiliary controller for controlling the ER devices, in accordance with another embodiment of the present disclosure.
Figure 9:
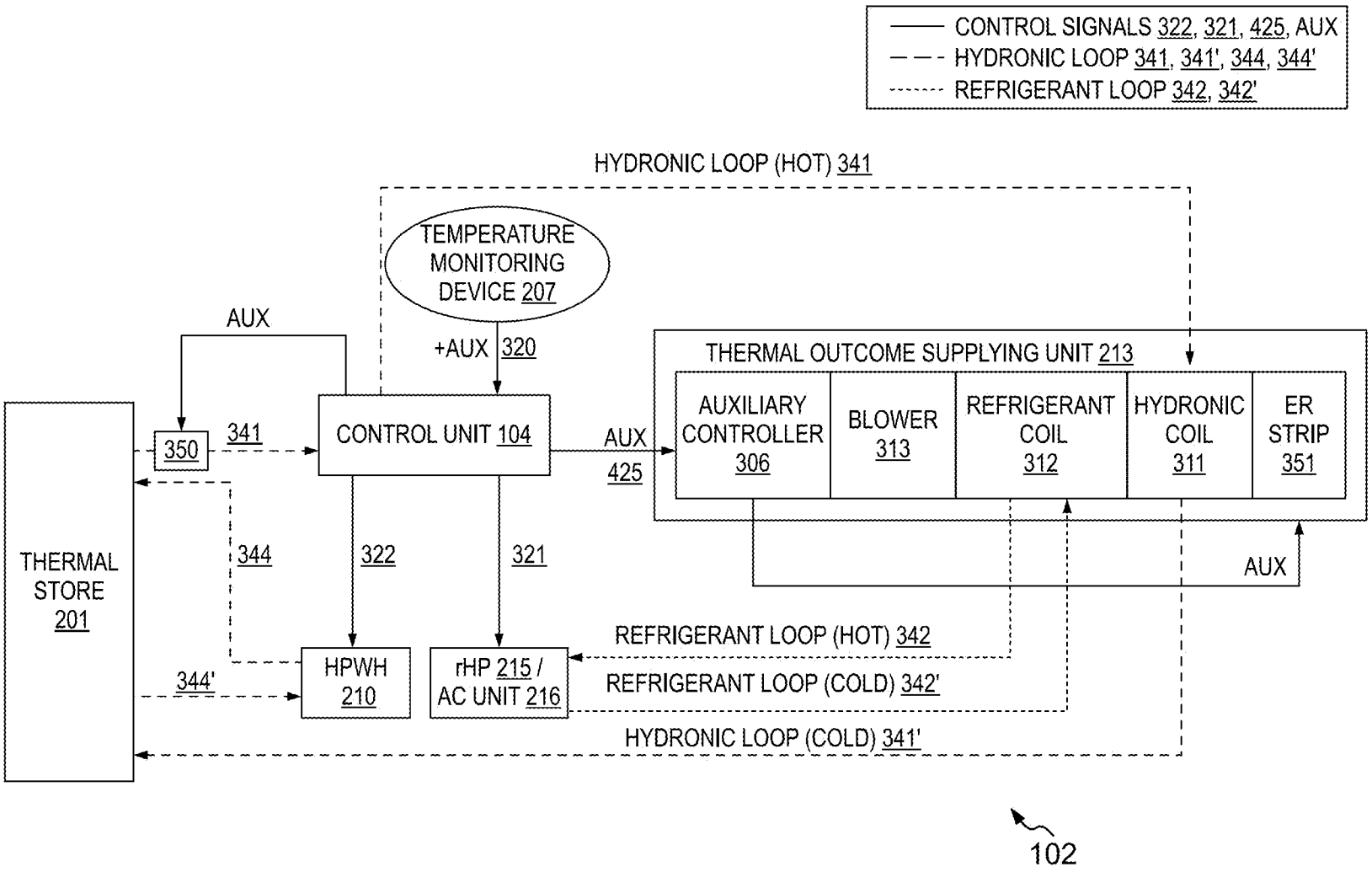
FIG. 9 illustrates a schematic diagram of an operating configuration of the ACPH system of FIG. 4, depicting the control unit for controlling the ER devices, in accordance with another embodiment of the present disclosure.

It should be noted if the internal logic of the thermal outcome supplying unit 213 selects for auxiliary heating, the thermal outcome supplying unit 213 will directly control the auxiliary heating function (explained in FIG. 8 and FIG. 9). The various wiring used in FIGS. 3A-3D to 9 and its explanation are given below.

a. Wire with the naming convention "W" is associated with a basic "call for heat". The "call for heat" is the signal given by the thermal outcome supplying unit 207 to the control unit 104 or the thermal outcome supplying unit 213.
b. Wire "Y" is often the naming convention for a wire that when energized with 24 V will cause the rHP 215 to run.
c. Wire "O" switches the valve (not shown in diagrams) of the rHPWH 211) from heating to cooling and vice versa.
d. Wire "G" controls air blowing speed of the blower 313.
e. Wire "X" or "Aux" (shown in FIG. 8 and FIG. 9) provides an auxiliary heating option in the rHPWH 211.
f. In some embodiments of the invention, the interface for the control signal is a digital communication interface such as Modbus or Ethernet.

Figure 3B:
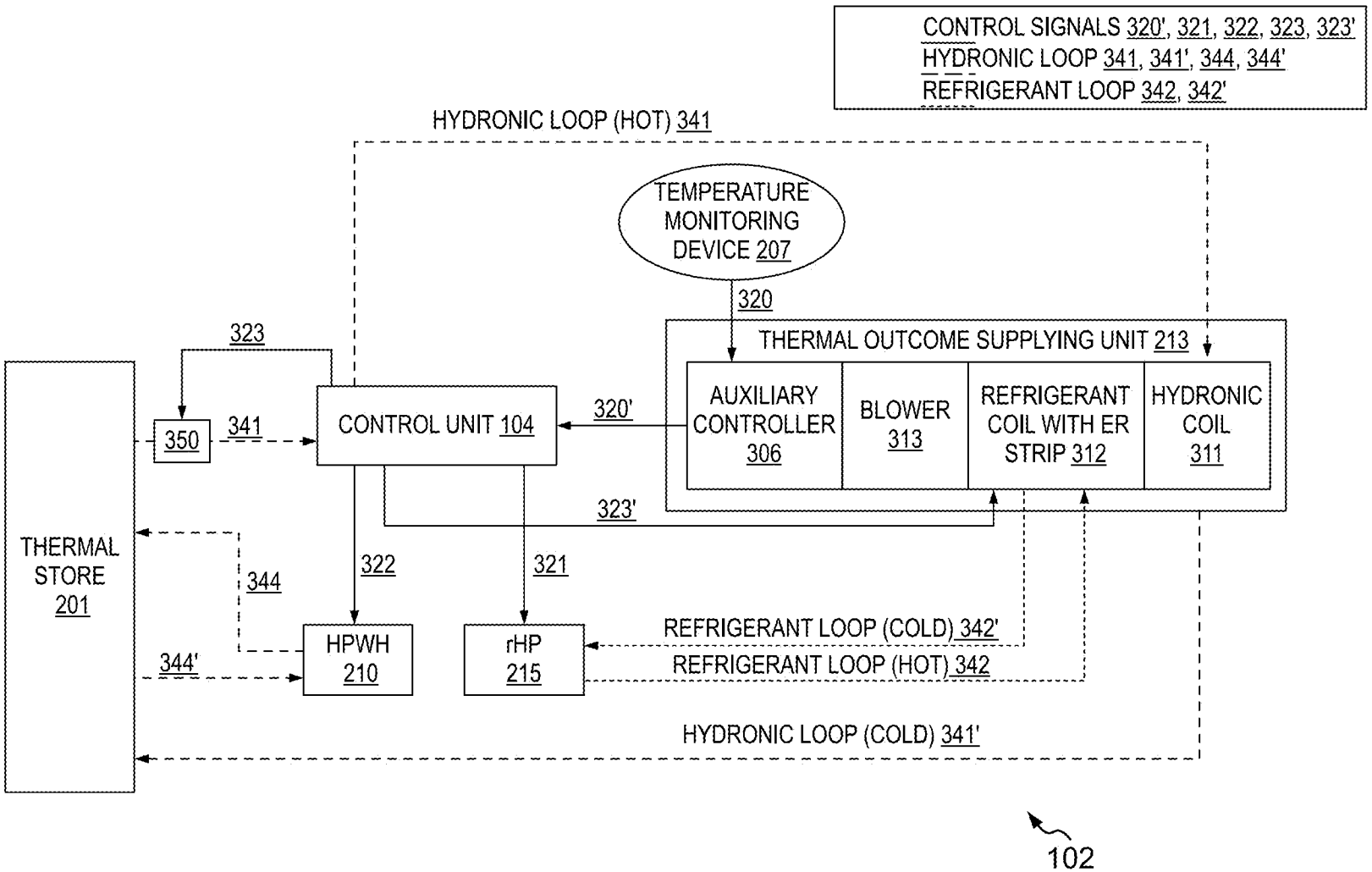
FIG. 3B illustrates a schematic diagram of an operating configuration of the ACPH system of FIG. 3A, showing electric resistance (ER) devices operatively coupled to a control unit, in accordance with an embodiment of the present disclosure.

FIG. 3B illustrates a schematic diagram of an operating configuration of the system 102, in accordance with an embodiment of the present disclosure. As shown, the system 102 includes the ER devices such as an ER booster 350 (Auxiliary) and the refrigerant coil with an ER strip 312 (or both). The ER booster 350 and the ER strip are operatively coupled to the control unit 104. The control unit 104 sends control signal 323 (e.g., ON/OFF/LEVEL signal) to the ER booster 350 and/or control signal 323' (e.g., ON/OFF/LEVEL signal to the refrigerant coil with ER strip 312) to satisfy the thermal energy requirements based on the operating scheme. In one embodiment, the thermal outcome supplying unit controller 306 sends a control signal (not shown) to the ER booster 350 or the ER strip to request the operation of auxiliary heating. In another embodiment, the control unit 104 may send ON/OFF control signal 323 to the ER booster 350 or the ER strip. The "LEVEL signal" of the control signal 323 is used to indicate the capacity level at which the ER booster 350 needs to be operated, while the "LEVEL signal" of the control signal 323' is used to indicate the capacity level at which the ER strip needs to be operated. The selective and instantaneous operations based on the operating scheme corresponding to the thermal energy requirements for the space conditioning and the potable hot water delivery are explained with reference to FIG. 3A, therefore they are not reiterated herein for the sake of brevity. However, the operations of the ER devices based on the operating scheme corresponding to the thermal energy requirements are listed below:

i. The ER booster 350 is used to further heat the fluid from the thermal store 201 before sending it to the hydronic coil 311 of the thermal outcome supplying unit 213.
ii. The refrigerant coil with the ER strip 312 is used to further heat the refrigerant in the refrigerant coil received from the rHP 215.

It should be noted that the ER booster 350 can be integrated with the thermal store 201 or it can be a stand-alone component to heat the fluid flowing in the hydronic loop 341 from the thermal store 201. Similarly, the ER strip or heater can be integrated with the refrigerant coil 312 or can be installed as one of the elements in the thermal outcome supplying unit 213.

Figure 3C:
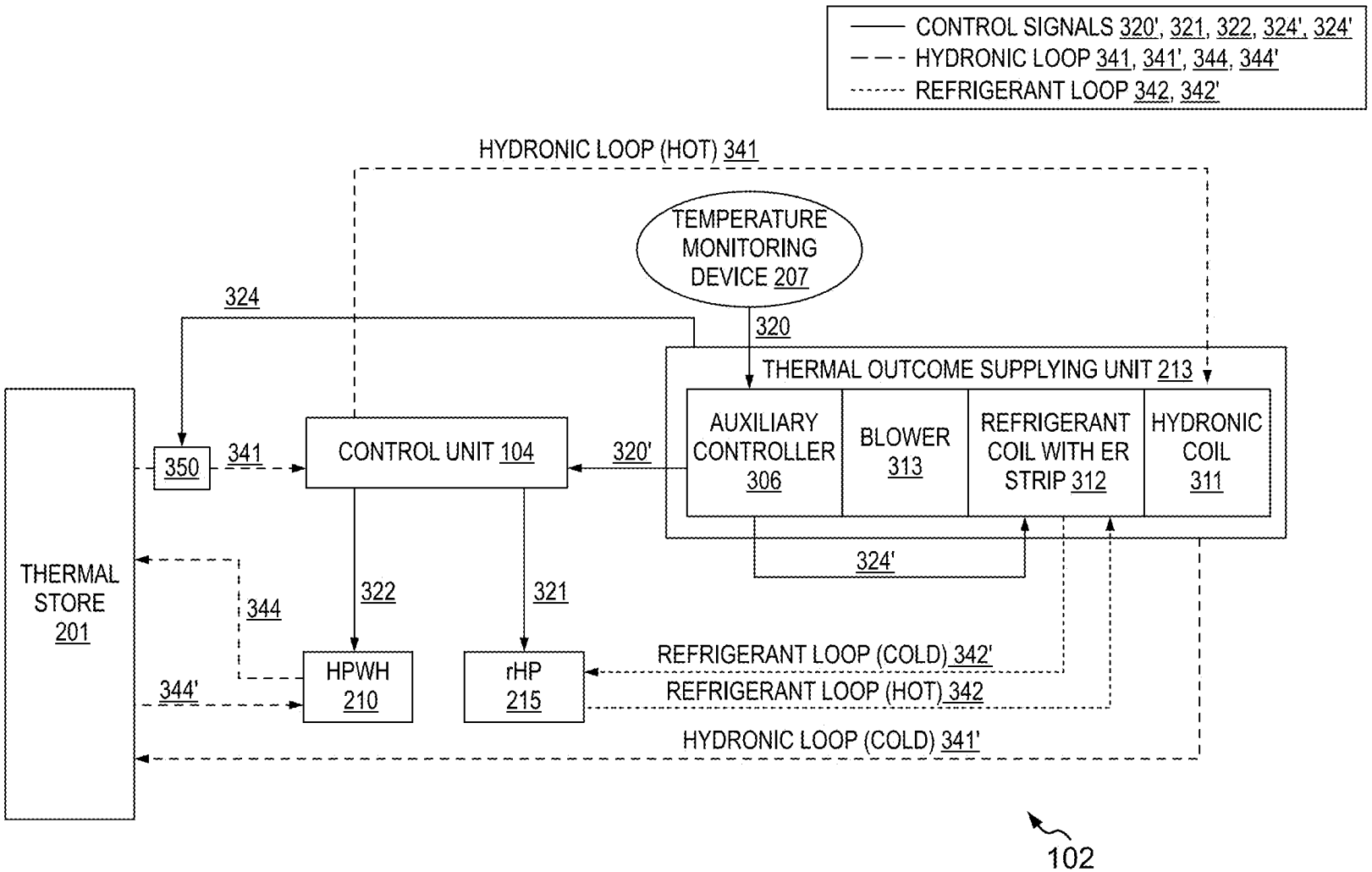
FIG. 3C illustrates a schematic diagram of an operating configuration of the ACPH system of FIG. 3A, showing the ER devices operatively coupled to an auxiliary controller associated with the thermal outcome supplying unit, in accordance with an embodiment of the present disclosure.

FIG. 3C illustrates a schematic diagram of an operating configuration of the system 102, in accordance with an embodiment of the present disclosure. In this configuration, the ER booster 350, and the refrigerant coil with the ER strip 312 are controlled by the auxiliary controller 306 for the space conditioning. The auxiliary controller 306 sends a control signal 324 (e.g., ON/OFF/LEVEL signal) to the ER booster 350 and/or a control signal 324' (e.g., ON/OFF/LEVEL signal) to the ER strip 312 to request the operation of auxiliary heating. The "ON signal" of the control signal 324 turns ON the ER booster 350, while the "OFF signal" of the control signal 324 turns OFF the ER booster 350. Similarly, the "ON signal" of the control signal 324' turns ON the ER strip 312, while the "OFF signal" of the control signal 324' turns OFF the ER strip 312. The "LEVEL signal" of the control signal 324 is used to indicate the capacity level at which the ER booster 350 needs to be operated, while the "LEVEL signal" of the control signal 324' is used to indicate the capacity level at which the ER strip 312 needs to be operated. The selective and instantaneous operations based on the operating scheme corresponding to the thermal energy requirements for the space conditioning and the potable hot water delivery are explained with reference to FIG. 3A, therefore they are not reiterated herein for the sake of brevity.

Figure 3D:
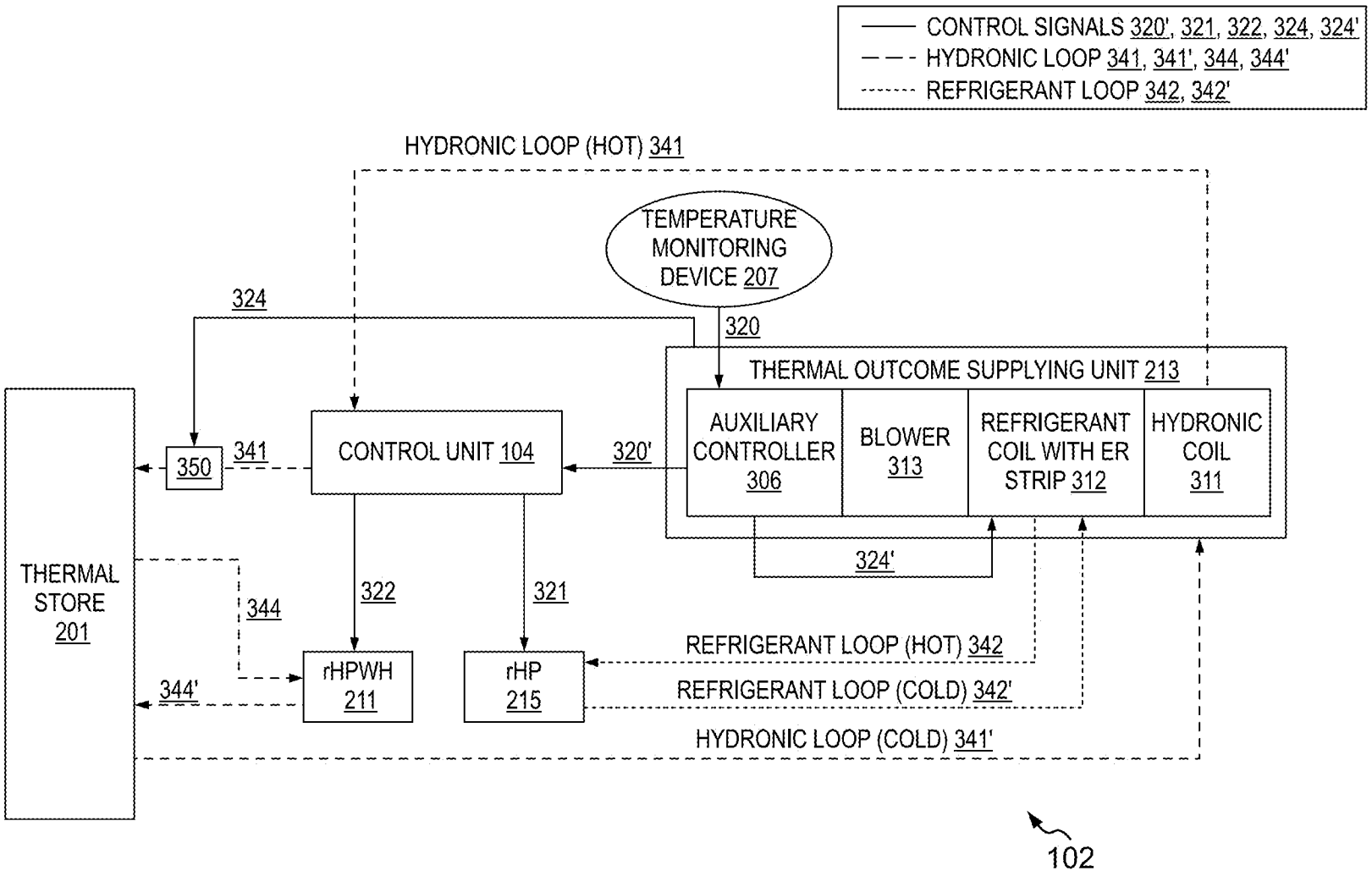
FIG. 3D illustrates a schematic diagram of an operating configuration of the ACPH system of FIG. depicting space conditioning of an enclosure and potable hot water delivery using a plurality of thermal energy systems, in accordance with another embodiment of the present disclosure.

FIG. 3D illustrates a schematic diagram of an operating configuration of the system 102, in accordance with an embodiment of the present disclosure. In this configuration, the system 102 is used for cooling end-user space and the potable hot water delivery using the rHPWH 211 and the rHP 215. The cold fluid from the thermal store 201 flows to the hydronic coil 311. The auxiliary controller 306 sends an OFF signal to the ER booster 350 and the refrigerant coil with the ER strip 312, so that no auxiliary heating takes place in the ER booster 350 and the refrigerant coil with the ER strip 312.

The various operating modes of the system 102 for cooling are listed below:

i. The thermal store 201 only: In this mode, the cold fluid stored in the thermal store 201 is supplied (via the hydronic loop (cold) 341') to the hydronic coil 311 for fulfilling the cooling requirement of the end-user.

ii. rHPWH and thermal store: The rHPWH 211 is operated in the reverse mode to cool the fluid (via the hydronic loop (hot) 341 from the thermal store 201) passing through it and return it as chilled water to the thermal store 201 (via the hydronic loop (cold) 341'). From the thermal store 201, the cold fluid is supplied to the hydronic coil 311 through a hydronic loop (via the hydronic loop (cold) 341') to fulfill the cooling requirement of the end-user.

iii. rHP only: The rHP 215 is operated in the reverse mode to cool the refrigerant (via the refrigerant loop (hot) 342 received from the refrigerant coil 312) passing through it. In this mode, the refrigerant flowing through the rHP 215 is cooled and supplied (via the refrigerant loop (cold) 342') back to the refrigerant coil 312 to fulfill the cooling requirement of the end-user.

vii. In modes i-iii, the blower 313 is operated to transfer heat from the hydronic coil 311 and the refrigerant coil 312 within the thermal outcome supplying unit 213 to end-user space.

iv. Blower only: In this mode, the temperature monitoring device 207 can operate the blower 313 to circulate air in the end-user space.

V. Combination of at least one of i to iv mentioned above.

Figure 4:
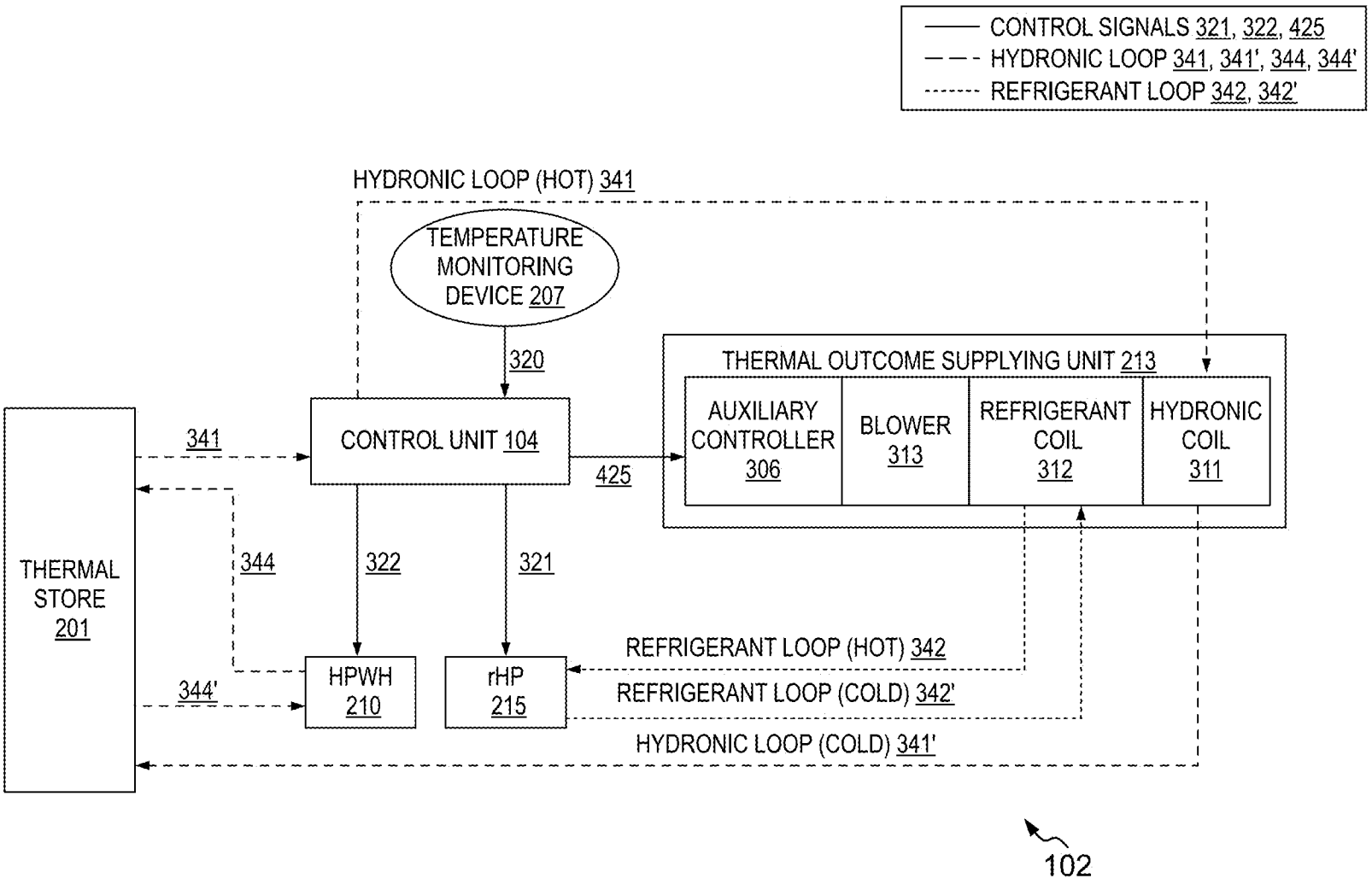
FIG. 4 illustrates a schematic diagram of an operating configuration of the ACPH system of FIG. 2, depicting the control unit connected to the temperature monitoring device for receiving thermal energy requirements, in accordance with another embodiment of the present disclosure.

FIG. 4 illustrates a schematic diagram of an operating configuration of the system 102, in accordance with an embodiment of the present disclosure. In this embodiment, the control unit 104 is connected to the temperature monitoring device 207 for receiving the at least one input signal indicating the thermal energy requirements for heating and cooling of end-user space and the potable hot water delivery. The control unit 104 may receive the information 320 from the temperature monitoring device 207 using Y/O wiring standards. The control unit 104 also receives the signals (e.g., the supply measurement signals 231, the demand measurement signals 232, and the operating factors 206). The control unit 104 can send control signal 425 to the auxiliary controller 306 via Y/O/Aux wiring standards. The auxiliary controller 306 is interfaced with the rHP 215 via Y/O wiring standards and sends the control signal 321 to the rHP 215. In variations on the disclosed configuration, the rHP 215 may accept other control signal standards, include for example signal standards that include ON/OFF/LEVEL with variable LEVEL signals (as described above for booster signals) to indicate the targeted operating capacity of the rHP 215. Based on the operating scheme, the control unit 104 sends an ON/OFF/LEVEL signal to the rHPWH 211 to indicate the targeted operating capacity of the rHPWH 211. The selective and instantaneous operations based on the operating scheme corresponding to the thermal energy requirements for the space conditioning and the potable hot water delivery are explained with reference to FIGS. 2 to 3A-3D, therefore they are not reiterated herein for the sake of brevity.

TABLE2: Various possible modes, interfaces, and operations of the system 102 of FIG. 4 are shown below. It is important to note the commonality to TABLE 1 allowing the control unit 104 to selectively operate rHP 215 and the HPWH 210 or the rHPWH 211 by commonly available control wiring standards:

| Design Logic | | | | | | |
|---|---|---|---|---|---|---|
| The Temperature monitoring device 207 | State | The Control signal 320 | The Control signal 321 | The Control signal 425 | The Control unit 104 | Explanation |
| Call for Heat | Hydronic preferred | Y | — | — | Circulation ON | Use thermal store when favorable |
| Call for Heat | RHP preferred | Y | Y | Y | — | Use rHP when favorable |
| Call for Heat | RHP preferred | Y | Y | Y | Circulation ON | Use thermal store and rHP when favorable |
| Call for Cool | Any | O + Y | O + Y | O + Y | — | Normal air conditioning |
| Fan | Any | G | — | G | — | Normal fan operation |
| Aux | Any | Varies | Varies | Varies | Varies | Auxiliary functions augmented or replaced by circulation when desired |
| NA | Any | Any | Any | Any | rHPWH ON | Charge thermal store when needed |

Figure 5:
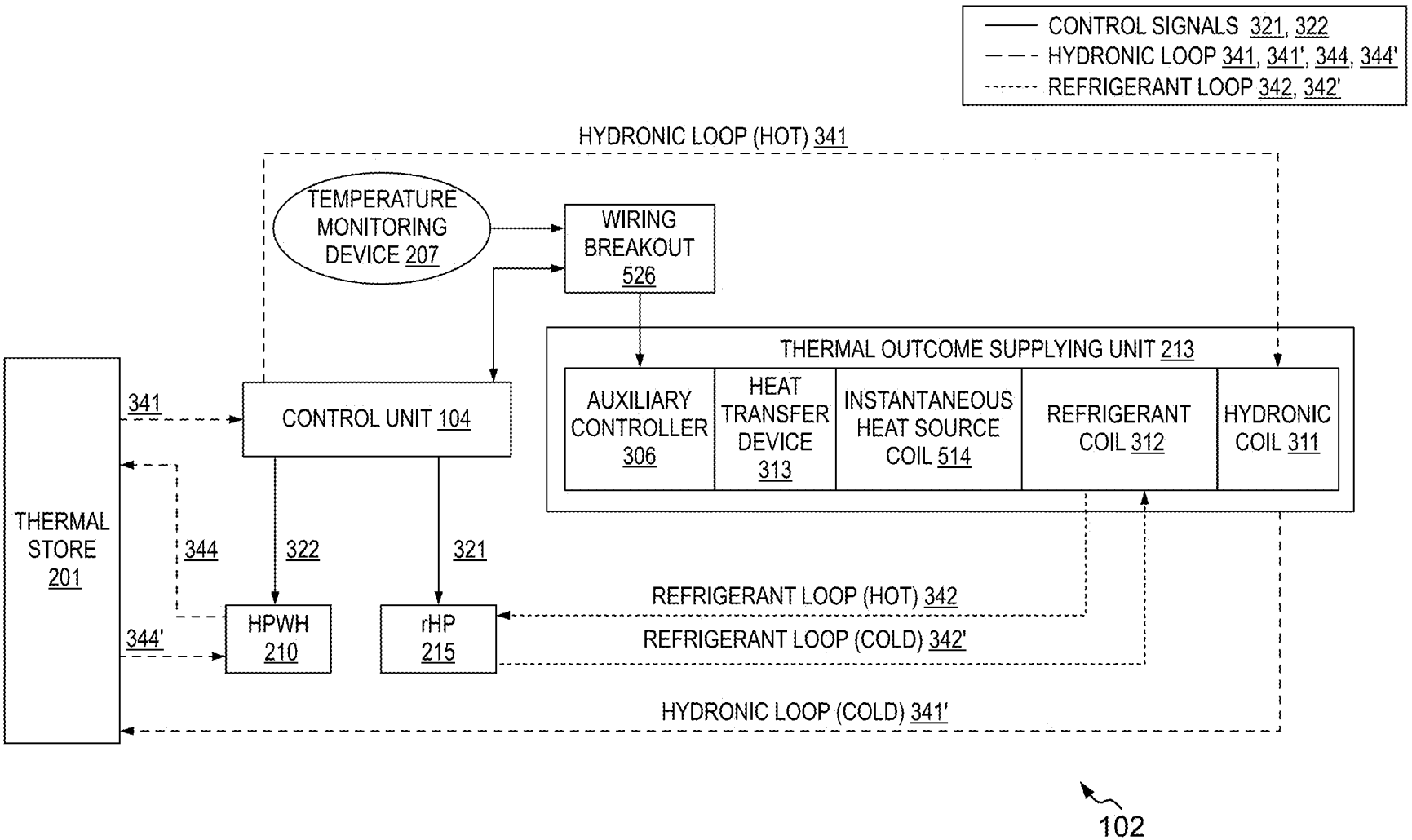
FIG. 5 illustrates a schematic diagram of an operating configuration of the ACPH system of FIG. 4, depicting a wiring breakout used for selectively connecting the temperature monitoring device to the control unit and the auxiliary controller, in accordance with another embodiment of the present disclosure.

FIG. 5 illustrates a schematic diagram of an operating scheme of the system 102, in accordance with an embodiment of the present disclosure. As shown, the system may include a wring breakout 526 for selectively connecting the temperature monitoring device 207 to the control unit 104 or the auxiliary controller 306. Using the wiring breakout 526 interfacing of the temperature monitoring device 207 with both the control unit 104 and the auxiliary controller 306 is possible without changing the wiring structure of the system 102. The temperature monitoring device 207 interfaces to the wiring breakout 526 and the wiring breakout 526 interfaces with the control unit 104 (using Y/O wiring standards) as well as with the auxiliary controller 306 of the thermal outcome supplying unit 213. Further, the thermal outcome supplying unit 213 may include an instantaneous heat source coil 514. The instantaneous heat source coil 514 can receive heat from at least one instantaneous heat source (e.g., furnace). The selective and instantaneous operations based on the operating scheme corresponding to the thermal energy requirements for the space conditioning and the potable hot water delivery are explained with reference to FIGS. 2 to 4, therefore they are not reiterated herein for the sake of brevity.

Figure 6:
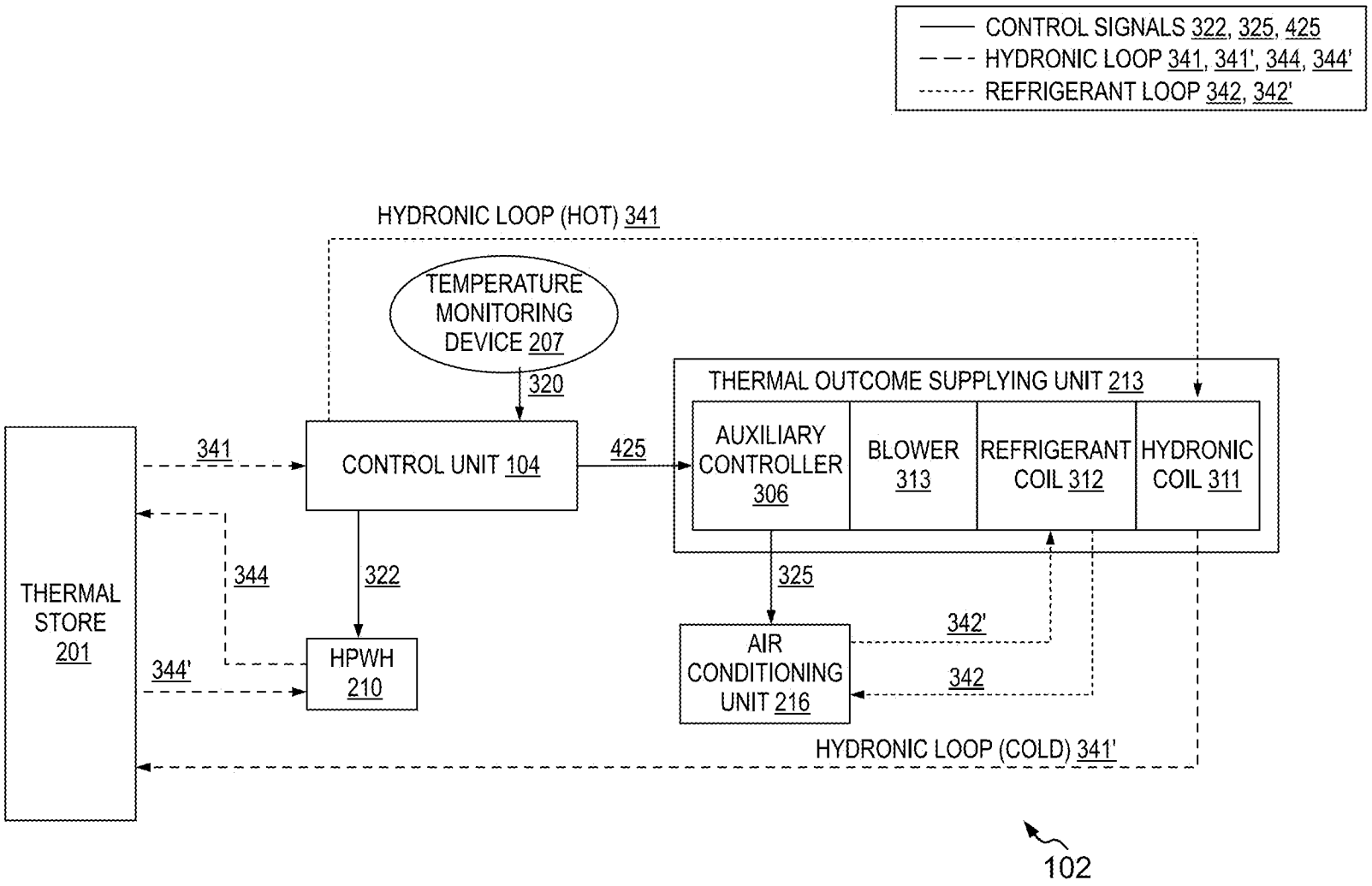
FIG. 6 illustrates a schematic diagram of an operating configuration of the ACPH system of FIG. 4, depicting an Air Conditioning (AC) unit operatively coupled to the auxiliary controller, in accordance with another embodiment of the present disclosure.

FIG. 6 illustrates a schematic diagram of an operating configuration of the system 102, in accordance with an embodiment of the present disclosure. As shown, the system 102 includes only the Air Conditioning (AC) unit 216 for cooling the end-user space and potable hot water delivery. The control unit 104 sends a control signal 425 to the thermal outcome supplying unit 213 when requested for cooling. Accordingly, the auxiliary controller 306 sends a signal 325 to the AC unit 216 using at least one of the Y/O wiring. The AC unit 216 cools the refrigerant fluid passing through it and supplies the same to the refrigerant coil 312 of the thermal outcome supplying unit 213. The AC unit 216 receives refrigerant fluid from the refrigerant coil 312 via the refrigerant loop (hot) 342, and cools the refrigerant fluid and sends back the refrigerant fluid to the refrigerant coil 312 via the refrigerant loop (cold) 342'. In the thermal outcome supplying unit 213, the refrigerant coil 312 cools the air (e.g., atmospheric air) by heat transfer before delivering to the end-user space. Further, the selective and instantaneous operations based on the operating scheme corresponding to the thermal energy requirements for the space conditioning and the potable hot water delivery are explained with reference to FIGS. 3A-3D to FIG. 5, therefore they are not reiterated herein for the sake of brevity.

TABLE 3 Various possible modes, interfaces, and operations of the system 102 of FIG. 6 are shown below:

| Design Logic | | | | |
|---|---|---|---|---|
| The Temperature monitoring device 207 | State | The Control signal 425 | The Control unit 104 | Explanation |
| Call for Heat | Hydronic preferred | G (fan on) | Circulation ON | Use thermal store when favorable |
| Call for Heat | instantaneous heat preferred | W (Run in heating mode) | — | Use instantaneous heat source when favorable |
| Call for Heat | Multi-source preferred | W (Run in heating mode) | Circulation ON | Use thermal store and rHP when favorable |
| Call for Cool | Any | Y Run in cooling mode | — | Normal air conditioning |
| Fan | Any | — | — | Normal fan operation |
| Aux | Any | Varies | — | Auxiliary functions unchanged |
| NA | Any | Any | rHPWH ON | Charge thermal store when needed |

Figure 7:
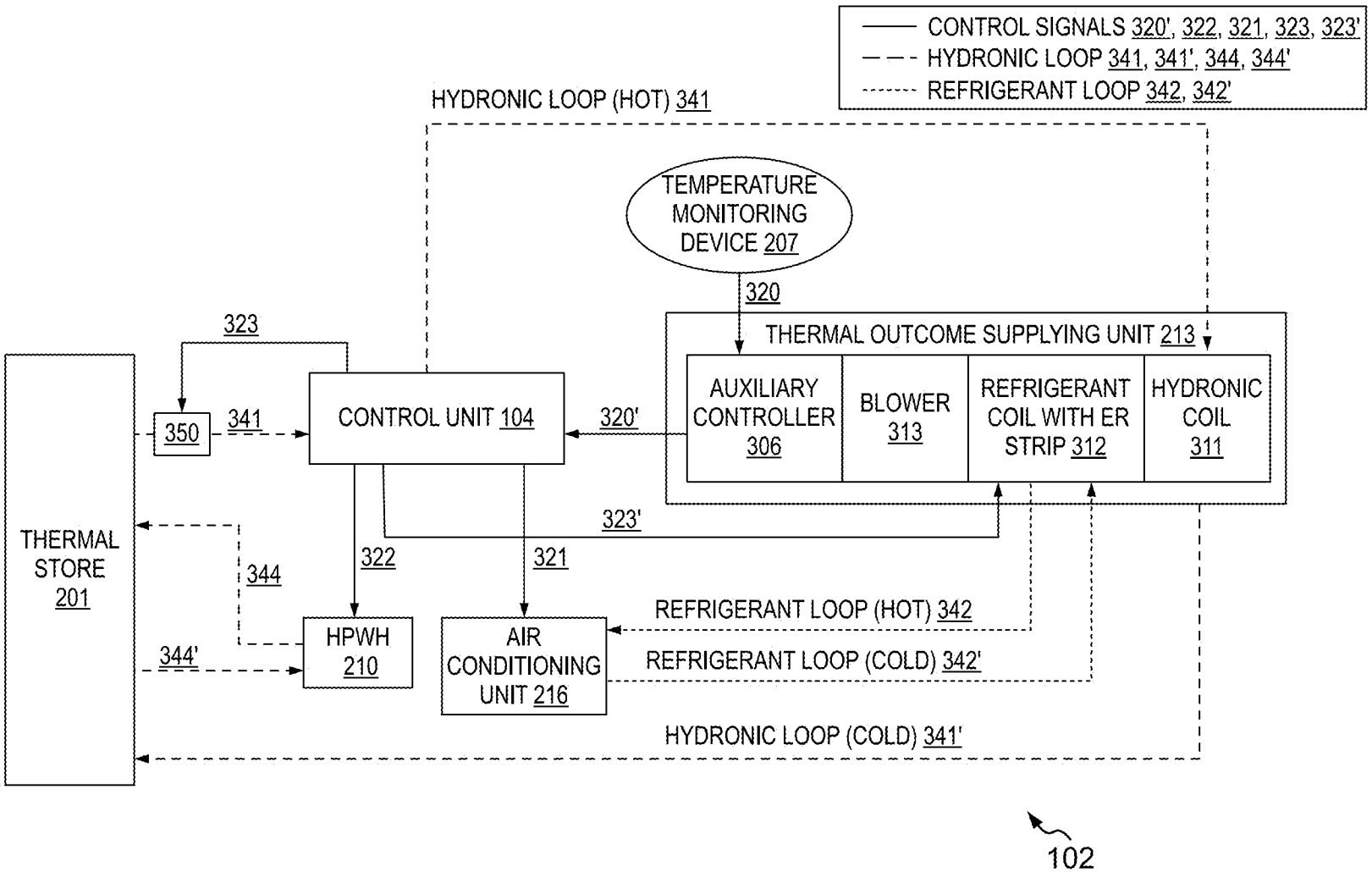
FIG. 7 illustrates a schematic diagram of an operating configuration of the ACPH system of FIG. 4 showing the ER devices, a refrigerant coil, and the AC unit associated with the plurality of thermal energy systems for the space conditioning and the potable hot water delivery, in accordance with another embodiment of the present disclosure.

FIG. 7 illustrates a schematic diagram of an operating configuration of the system 102, in accordance with an embodiment of the present disclosure. In this configuration, the system 102 includes the ER booster 350 and the refrigerant coil with the ER strip 312 operatively coupled to the control unit 104. The AC unit 216 cools the refrigerant fluid and supplies the same to the refrigerant coil 312 of the thermal outcome supplying unit 213. The AC unit 216 receives the refrigerant fluid from the refrigerant coil with ER strip 312 via the refrigerant loop (hot) 342 and cools the refrigerant fluid. The cooled refrigerant fluid is sent back to the refrigerant coil with ER strip 312 via the refrigerant loop (cold) 342'. In the thermal outcome supplying unit 213, the refrigerant coil with ER strip 312, cooled air is delivered to the end-user space. In this mode, the auxiliary controller 306 sends an OFF signal to the ER booster 350 and the refrigerant coil with the ER strip 312, thereby turning OFF the heating process of the ER booster 350 and the refrigerant coil with ER strip 312. Further, the selective and instantaneous operations based on the operating scheme corresponding to the thermal energy requirements for the space conditioning and the potable hot water delivery are explained with reference to FIGS. 2 to 6, therefore they are not reiterated herein for the sake of brevity.

FIG. 8 illustrates a schematic diagram of an operating configuration of the system 102, in accordance with an embodiment of the present disclosure. As shown, an auxiliary control signal (+Aux) is received from the temperature monitoring device 207 for controlling the ER booster 350 and an ER strip 351. The auxiliary signal (AUX) supplied to the auxiliary controller 306 from the temperature monitoring device 207 is used to turn ON/OFF the ER booster 350 and the ER strip 351. The control unit 104 receives the auxiliary signal (AUX) from the auxiliary controller 306 for controlling the ER booster 350. The ER strip 351 is controlled using the auxiliary signal (AUX) from the auxiliary controller 306.

FIG. 9 illustrates a schematic diagram of an operating configuration of the system 102, in accordance with an embodiment of the present disclosure. The auxiliary control signal (+Aux) is received from the temperature monitoring device 207 for controlling the ER booster 350 and the ER strip 351. As shown, the auxiliary signal (AUX) is supplied to the control unit 104 from the temperature monitoring device 207. In response to the AUX signal, the control unit 104 is configured to turn ON/OFF the ER booster 350. From the control unit 104, the auxiliary signal (AUX) is supplied to the auxiliary controller 306 for controlling the ER strip 351. The auxiliary control signal (+Aux) can be used in case any specific control signal is to be used for controlling the heating and cooling systems, other than the control signals generated by the algorithm of the present invention.

The algorithm (of the control unit 104 and/or the auxiliary controller 306) prioritizes the operation of the different components of the system 102 for costs, emissions, efficiency, or other parameters, the SoC of the thermal store 201 which will be able to deliver heating, cooling, and the potable hot water delivery to the end-user. The operating scheme is generated by the algorithm so that heating, cooling, and the potable hot water can be delivered to the end-user either from the thermal store 201 and/or thermal energy systems.

Figure 10:
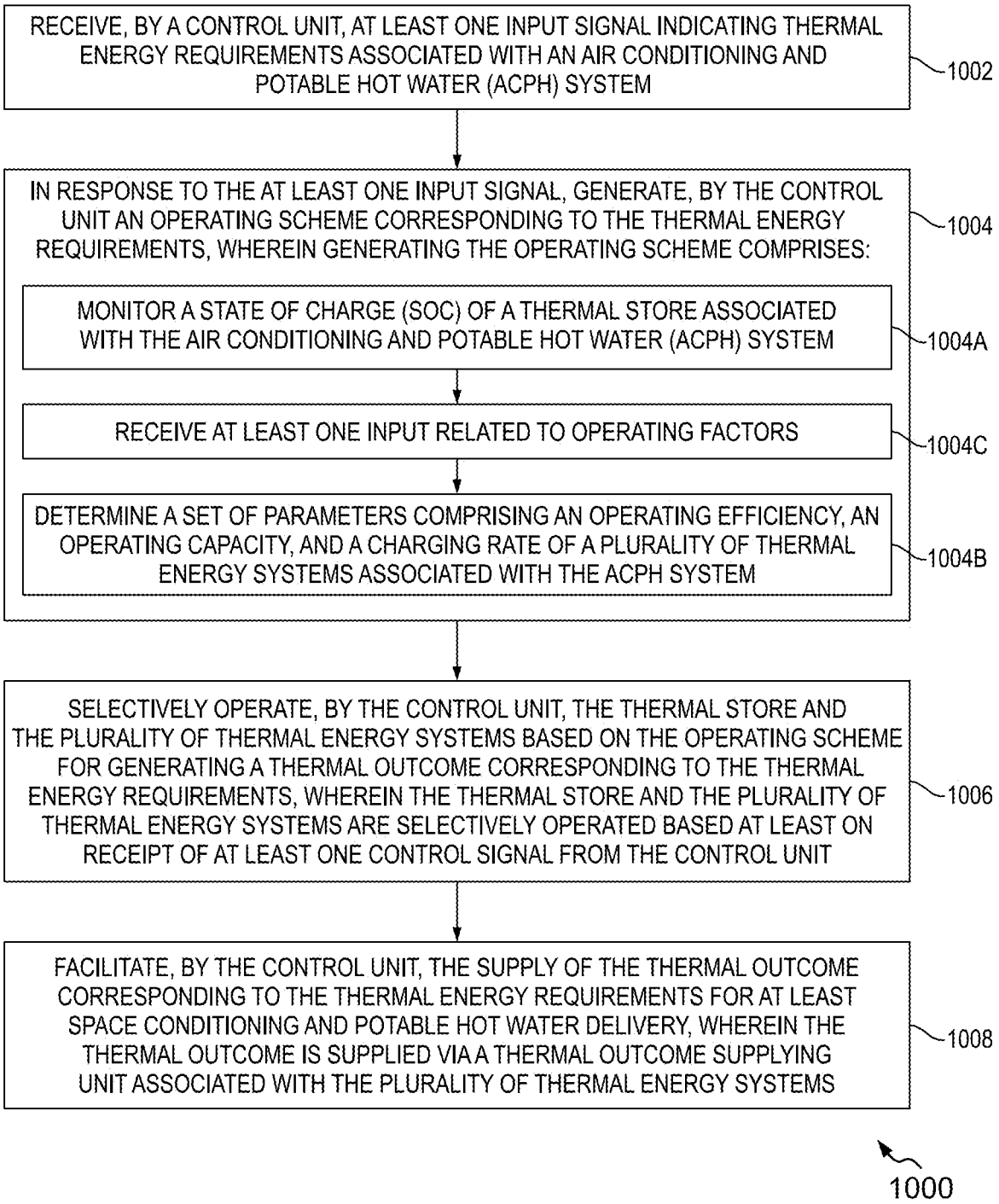
FIG. 10 illustrates a flow diagram of a computer-implemented method for controlling heating, ventilation, cooling, and potable hot water delivery, in accordance with an embodiment of the present disclosure.

FIG. 10 illustrates a flow diagram of a computer-implemented method 1000 for controlling heating, ventilating, cooling, and potable hot water delivery, in accordance with an embodiment of the present disclosure. The method 1000 depicted in the flow diagram may be executed by, for example, the system 102. Operations of the flow diagram of the method 1000, and combinations of the operations in the flow diagram of the method 1000, may be implemented by, for example, hardware, firmware, a processor, circuitry, and/or a different device associated with the execution of software that includes one or more computer program instructions. It is noted that the operations of the method 1000 can be described and/or practiced by using a system other than the system 102. The method 1000 starts at operation 1002.

At operation 1002, the method 1000 includes receiving, by the control unit 104, at least one input signal indicating thermal energy requirements associated with the Air Conditioning and Potable Hot Water (ACPH) system 102.

At operation 1004, in response to the at least one input signal, the method 1000 includes generating, by the control unit an operating scheme for at least generating thermal outcome corresponding to the thermal energy requirements.

At operation 1004A, generating the operating scheme includes monitoring a State of Charge (SoC) of the thermal store 201 associated with the Air Conditioning and Potable Hot Water (ACPH) system 102.

At operation 1004B, generating the operating scheme includes receiving at least one input related to operating factors.

At operation 1004C, generating the operating scheme includes determining a set of parameters including an operating efficiency and an operating capacity associated with the plurality of thermal energy systems associated with the ACPH system 102.

At operation 1006, the method 1000 includes selectively operating, by the control unit 104, the thermal store 201, and the plurality of thermal energy systems based on the operating scheme for generating a thermal outcome corresponding to the thermal energy requirements. The thermal store 201 and the plurality of thermal energy systems are selectively operated based at least on receipt of at least one control signal from the control unit 102.

At operation 1008, the method 1000 includes supplying, by the control unit 104, the thermal outcome corresponding to the thermal energy requirements for at least space conditioning and potable hot water delivery. The thermal outcome is supplied via the thermal outcome supplying unit 213 associated with the plurality of thermal energy systems. Further, the one or more operations related to generating of optimized operating plan and the selective operations of the thermal store 201 and the thermal energy systems for the space conditioning and the potable hot water delivery are explained with reference to FIGS. 1 to 9, therefore they are not reiterated herein for the sake of brevity.

Various embodiments of the disclosure, as discussed above, may be practiced with steps and/or operations in a different order, and/or with hardware elements in configurations, which are different than those which, are disclosed. Therefore, although the disclosure has been described based on these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A computer-implemented method, comprising:

receiving, by a control unit, at least one input signal indicating thermal energy requirements associated with an Air Conditioning and Potable Hot Water (ACPH) system;

in response to the at least one input signal, generating, by the control unit an operating scheme corresponding to the thermal energy requirements, wherein generating the operating scheme comprises:

monitoring a State of Charge (SoC) of a thermal store associated with the Air Conditioning and Potable Hot Water (ACPH) system, receiving at least one input related to operating factors, and determining a set of parameters comprising an operating efficiency, an operating capacity, and a charging rate of a plurality of thermal energy systems associated with the ACPH system;

selectively operating, by the control unit, the thermal store and the plurality of thermal energy systems based on the operating scheme for generating a thermal outcome corresponding to the thermal energy requirements, wherein the thermal store and the plurality of thermal energy systems are selectively operated based at least on receipt of at least one control signal from the control unit; and facilitating, by the control unit, the supply of the thermal outcome corresponding to the thermal energy requirements for at least space conditioning and potable hot water delivery, wherein the thermal outcome is supplied via a thermal outcome supplying unit associated with the plurality of thermal energy systems.

2. The computer-implemented method as claimed in claim 1, wherein the at least one input signal is received from a temperature monitoring device, the at least one input signal indicating the thermal energy requirements related to the space conditioning to the control unit, the space conditioning comprising at least one of heating and cooling of an enclosure.

3. The computer-implemented method as claimed in claim 2, further comprising:

generating, by the control unit, an operating scheme corresponding to the thermal energy requirements related to the space conditioning based at least on an operation cycle comprising a cost, emissions, and a schedule of operation of a power source; and selectively operating, by the control unit, a plurality of thermal energy systems based at least on the operating scheme to supply a thermal outcome for the space conditioning.

4. The computer-implemented method as claimed in claim 3, wherein the operation cycle is at least an off-peak operation cycle, and wherein the cost and the schedule of operation of the power source are defined in a look-up table configured in a database communicably coupled to the control unit.

5. The computer-implemented method as claimed in claim 4, wherein a thermal outcome being generated in the off-peak operation cycle by selectively operating a plurality of thermal energy systems is used to recharge a volume of fluid stored in a thermal store.

6. The computer-implemented method as claimed in claim 2, further comprising instantaneously operating, by the control unit, a thermal outcome supplying unit operatively coupled to a thermal store to supply a thermal outcome by utilizing the thermal store for the space conditioning based at least on determining a SoC of the thermal store is at least equivalent to the thermal energy requirements for the space conditioning and an operation cycle being an on-peak operation cycle and an off-peak operation cycle.

7. The computer-implemented method as claimed in claim 6, further comprising controlling, by the control unit, the thermal outcome supplying unit to selectively operate the plurality of thermal energy systems and the thermal store to supply the thermal outcome corresponding to the thermal energy requirements related to the space conditioning based on determining at least:

the SoC of the thermal store is less than the thermal energy requirements for the space conditioning;

the operating capacity, the operating efficiency, and the charging rate of each of the plurality of thermal energy systems; and the operation cycle being one of the on-peak operation cycle and the off-peak operation cycle.

8. The computer-implemented method as claimed in claim 1, wherein the at least one input signal indicates the thermal energy requirements related to the potable hot water delivery, and wherein generating the operating scheme comprises:

determining, by the control unit, the SoC of the thermal store is at least equivalent to the thermal energy requirements of the potable hot water delivery;

generating, by the control unit, the operating scheme corresponding to the thermal energy requirements of the potable hot water delivery in response to determining the SoC of the thermal store is at least equivalent to the thermal energy requirements of the potable hot water delivery, and an operation cycle, the operation cycle being one of an on-peak operation cycle and an off-peak operation cycle; and instantaneously operating, by the control unit, the thermal outcome supplying unit operatively coupled to the thermal store to provide the thermal outcome for the potable hot water delivery based on the operating scheme.

9. The computer-implemented method as claimed in claim 8, further comprising:

determining, by the control unit, the SoC of the thermal store is less than the thermal energy requirements of the potable hot water delivery;

generating, by the control unit, the operating scheme corresponding to the thermal energy requirements related to the potable hot water delivery in response to determining the SoC of the thermal store is less than the thermal energy requirements of the potable hot water delivery, the operation cycle being the on-peak operation cycle, the operating factors, and the operating efficiency, the operating capacity, and the charging rate of each of the plurality of thermal energy systems; and controlling, by the control unit, the thermal outcome supplying unit for selectively operating the thermal store and the plurality of thermal energy systems to provide the thermal outcome based on the operating scheme for the potable hot water delivery.

10. The computer-implemented method as claimed in claim 8, further comprising:

generating, by the control unit, the operating scheme corresponding to the thermal energy requirements related to the potable hot water delivery based at least on the operation cycle comprising a cost, emissions, and a schedule of operation of a power source, the operation cycle being at least the off-peak operation cycle, wherein the cost and the schedule of operation of the power source are defined in a look-up table configured in a database communicably coupled to the control unit; and selectively operating, by the control unit, the plurality of thermal energy systems based at least on the operating scheme to supply the thermal outcome for the potable hot water delivery.

11. The computer-implemented method as claimed in claim 1, wherein the operating factors comprise at least ambient condition and prediction data comprising future thermal energy requirements, and wherein the prediction data is determined based on historical usage patterns and the ambient condition.

12. The computer-implemented method as claimed in claim 1, wherein the plurality of thermal energy systems and the thermal outcome supplying unit comprises at least a heat pump water heater (HPWH), a reversible heat pump (rHP), a blower, and wherein the control unit is configured to operate at least one of the heat pump water heater (HPWH) and the reversible heat pump (rHP) in at least one of a normal mode and a reversible mode for providing the thermal outcome corresponding to the thermal energy requirements.

13. The computer-implemented method as claimed in claim 1, wherein the at least one control signal for selectively operating the thermal store, the plurality of thermal energy systems, and the thermal outcome supplying unit is communicated using at least one second signal protocol, and wherein the at least one input signal indicating the thermal energy requirements is communicated using at least one first signal protocol.

14. The computer-implemented method as claimed in claim 1, wherein the at least one control signal for selectively operating the thermal store and the plurality of thermal energy systems based on the operating scheme comprises one of an ON instruction, an OFF instruction, and a LEVEL determination instruction to select at least one of the operating capacity of the thermal store and one or more of the plurality of thermal energy systems.

15. An Air Conditioning and Potable Hot Water (ACPH) system, comprising:

a thermal store configured to store thermal energy;

a plurality of thermal energy systems operatively coupled to the thermal store; and a control unit operatively coupled to the thermal store and the plurality of thermal energy systems, the control unit configured at least, in part to:

receive at least one input signal indicating thermal energy requirements associated with the Air Conditioning and Potable Hot Water (ACPH) system, in response to the at least one input signal, generate an operating scheme corresponding to the thermal energy requirements, wherein generating the operating scheme comprises:

monitor a State of Charge (SoC) of the thermal store, receive at least one input related to operating factors, and determine a set of parameters comprising an operating efficiency, an operating capacity, and a charging rate associated with the plurality of thermal energy systems, selectively operate the thermal store and the plurality of thermal energy systems based on the operating scheme for generating the thermal outcome corresponding to the thermal energy requirements, wherein the thermal store and the plurality of thermal energy systems are selectively operated based at least on receipt of at least one control signal from the control unit, and facilitate the supply of the thermal outcome corresponding to the thermal energy requirements for at least space conditioning and potable hot water delivery, wherein the thermal outcome is supplied via a thermal outcome supplying unit associated with the plurality of thermal energy systems.

16. The Air Conditioning and Potable Hot Water (ACPH) system as claimed in claim 15, further comprising a temperature monitoring device configured to transmit the at least one input signal indicating the thermal energy requirements related to the space conditioning to the control unit, the space conditioning comprising at least one of heating and cooling of an enclosure.

17. The Air Conditioning and Potable Hot Water (ACPH) system as claimed in claim 16, wherein the control unit is further configured at least, in part to:

generate an operating scheme corresponding to the thermal energy requirements related to the space conditioning based at least on an operation cycle comprising a cost, emissions, and a schedule of operation of a power source; and selectively operate a plurality of thermal energy systems based at least on the operating scheme to supply a thermal outcome for the space conditioning.

18. The Air Conditioning and Potable Hot Water (ACPH) system as claimed in claim 17, wherein the operation cycle is at least an off-peak operation cycle, and wherein the cost and the schedule of operation of the power source are defined in a look-up table configured in a database communicably coupled to the control unit.

19. The Air Conditioning and Potable Hot Water (ACPH) system as claimed in claim 18, wherein a thermal outcome being generated in the off-peak operation cycle by selectively operating a plurality of thermal energy systems is used to recharge a volume of fluid stored in a thermal store.

20. The Air Conditioning and Potable Hot Water (ACPH) system as claimed in claim 16, wherein the control unit is further configured to instantaneously operate a thermal outcome supplying unit operatively coupled to a thermal store to supply a thermal outcome by utilizing the thermal store for the space conditioning based at least on determining a SoC of the thermal store is at least equivalent to the thermal energy requirements for the space conditioning and an operation cycle being an on-peak operation cycle and an off-peak operation cycle.

21. The Air Conditioning and Potable Hot Water (ACPH) system as claimed in claim 20, wherein the control unit is further configured at least, in part to:

control the thermal outcome supplying unit to selectively operate the plurality of thermal energy systems and the thermal store to supply the thermal outcome corresponding to the thermal energy requirements related to the space conditioning based at least on:

the SoC of the thermal store is less than the thermal energy requirements for the space conditioning, the operating capacity, the operating efficiency, and the charging rate of each of the plurality of thermal energy systems, and the operation cycle being one of the on-peak operation cycle and an off-peak operation cycle.

22. The Air Conditioning and Potable Hot Water (ACPH) system as claimed in claim 15, wherein the at least one input signal indicates the thermal energy requirements related to the potable hot water delivery, and wherein the control unit is configured to at least, in part to:

determine the SoC of the thermal store is at least equivalent to the thermal energy requirements of the potable hot water delivery;

generate the operating scheme corresponding to the thermal energy requirements of the potable hot water delivery in response to determining the SoC of the thermal store is at least equivalent to the thermal energy requirements of the potable hot water delivery, and an operation cycle, the operation cycle being one of an on-peak operation cycle and an off-peak operation cycle; and instantaneously operate the thermal outcome supplying unit operatively coupled to the thermal store to provide the thermal outcome for the potable hot water delivery based on the operating scheme.

23. The Air Conditioning and Potable Hot Water (ACPH) system as claimed in claim 22, wherein the control unit is further configured at least, in part to:

determine the SoC of the thermal store is less than the thermal energy requirements of the potable hot water delivery;

generate the operating scheme corresponding to the thermal energy requirements related to the potable hot water delivery in response to determining the SoC of the thermal store is less than the thermal energy requirements of the potable hot water delivery, the operation cycle being the on-peak operation cycle, the operating factors, and the operating efficiency, the operating capacity, and the charging rate of each of the plurality of thermal energy systems; and control the thermal outcome supplying unit for selectively operating the thermal store and the plurality of thermal energy systems to provide the thermal outcome based on the operating scheme for the potable hot water delivery.

24. The Air Conditioning and Potable Hot Water (ACPH) system as claimed in claim 22, wherein the control unit is further configured at least, in part to:

generate the operating scheme corresponding to the thermal energy requirements related to the potable hot water delivery based at least on the operation cycle comprising a cost, emissions, and a schedule of operation of a power source, the operation cycle being at least the off-peak operation cycle, wherein the cost and the schedule of operation of the power source are defined in a look-up table configured in a database communicably coupled to the control unit; and selectively operate the plurality of thermal energy systems based at least on the operating scheme to supply the thermal outcome for the potable hot water delivery.

25. The Air Conditioning and Potable Hot Water (ACPH) system as claimed in claim 15, wherein the operating factors comprise at least ambient condition and prediction data comprising future thermal energy requirements, and wherein the prediction data is determined based on historical usage patterns and the ambient condition.

26. The Air Conditioning and Potable Hot Water (ACPH) system as claimed in claim 15, wherein the plurality of thermal energy systems and the thermal outcome supplying unit comprises at least a heat pump water heater (HPWH), a reversible heat pump (rHP), a blower, and wherein the control unit is configured to operate at least one of the heat pump water heater (HPWH) and the reversible heat pump (rHP) in at least one of a normal mode and a reversible mode for providing the thermal outcome corresponding to the thermal energy requirements.

27. The Air Conditioning and Potable Hot Water (ACPH) system as claimed in claim 15, wherein the at least one control signal for selectively operating the thermal store, the plurality of thermal energy systems, the thermal outcome supplying unit is communicated using at least one second signal protocol, and wherein the at least one input signal indicating the thermal energy requirements is communicated using at least one first signal protocol.

28. The Air Conditioning and Potable Hot Water (ACPH) system as claimed in claim 15, wherein the at least one control signal for selectively operating the thermal store and the plurality of thermal energy systems based on the operating scheme comprises one of an ON instruction, an OFF instruction, and a LEVEL determination instruction to select at least one of the operating capacity of the thermal store and one or more of the plurality of thermal energy systems.

* * * * *